US012729026B2

(12) United States Patent
Chalkley et al.

(10) Patent No.: US 12,729,026 B2
(45) Date of Patent: Sep. 8, 2026

(54) ROTATABLE APPARATUSES AND METHODS OF OPERATING THE SAME

(71) Applicant: Altria Client Services LLC, Richmond, VA (US)

(72) Inventors: Jarrod W. Chalkley, Mechanicsville, VA (US); Sean Sundberg, Richmond, VA (US); Robert Powell, Midlothian, VA (US); Isaac J. McGill, Richmond, VA (US); Charles Dendy, Ruther Glen, VA (US)

(73) Assignee: Altria Client Services LLC, Richmond, VA (US)

( * ) Notice: Subject to any disclaimer, the term of this patent is extended or adjusted under 35 U.S.C. 154(b) by 0 days.

(21) Appl. No.: 18/946,315

(22) Filed: Nov. 13, 2024

(65) Prior Publication Data

US 2025/0162750 A1 May 22, 2025

Related U.S. Application Data

(60) Provisional application No. 63/599,759, filed on Nov. 16, 2023.

(51) Int. Cl.
*B65B 39/14* (2006.01)
*B65B 9/04* (2006.01)
(Continued)

(52) U.S. Cl.
CPC ..... *B65B 39/145* (2013.01); *B65B 9/04* (2013.01); *B65B 35/46* (2013.01); *B65B 39/04* (2013.01);
(Continued)

(58) Field of Classification Search
CPC ..... B65B 29/00; B65B 39/007; B65B 39/00; B65B 39/145
See application file for complete search history.

(56) References Cited

U.S. PATENT DOCUMENTS 1,459,492 A 6/1923 Ayars
2,900,774 A 8/1959 Henriksen
(Continued)

FOREIGN PATENT DOCUMENTS

KR 2023-0081435 A 6/2023

OTHER PUBLICATIONS

International Search Report dated Mar. 26, 2025 for corresponding International Application No. PCT/US2024/055609.
(Continued)

*Primary Examiner* — Timothy P. Kelly
(74) *Attorney, Agent, or Firm* — Harness, Dickey & Pierce, P.L.C.

(57) ABSTRACT

A packaging machine includes a rotatable apparatus and an ejection system. The rotatable apparatus rotates a plurality of funnels around a first central rotation axis at a first rate of rotation while a plurality of containers move continuously along an arcuate path while remaining axially aligned with separate, respective bottom openings of the plurality of funnels. The ejection system ejects separate pluralities of material articles from a fixed ejection position at a fixed time interval, and the rotatable apparatus receives the separate pluralities of material articles at a fixed material receiving position. The rotatable apparatus directs a same quantity of material articles into each continuously moving container based on rotating around the first central rotation axis such that each separate funnel moves continuously through the material receiving position concurrently with the rotatable apparatus receiving at least one plurality of material articles at the fixed material receiving position.

19 Claims, 14 Drawing Sheets

(51) Int. Cl.

| | |
|---|---|
| ***B65B 35/46*** | (2006.01) |
| ***B65B 39/04*** | (2006.01) |
| ***B65B 43/60*** | (2006.01) |

(52) U.S. Cl.
CPC ..... *B65B 43/60* (2013.01); *B65B 2009/047* (2013.01)

(56) References Cited

U.S. PATENT DOCUMENTS

| | | | | |
|---|---|---|---|---|
| 4,061,164 | A | | 12/1977 | Sato et al. |
| 5,605,183 | A | * | 2/1997 | Hartman ..... B65B 39/145 141/237 |
| 5,762,116 | A | | 6/1998 | Moore |
| 6,119,440 | A | | 9/2000 | Benner, Jr. et al. |
| 6,837,281 | B2 | | 1/2005 | Spiers et al. |
| 9,845,170 | B2 | | 12/2017 | Evans et al. |
| 10,994,879 | B2 | | 5/2021 | Schwartz et al. |
| 11,407,534 | B2 | | 8/2022 | Nelson et al. |
| 2014/0174026 | A1 | | 6/2014 | Iimori et al. |

OTHER PUBLICATIONS

International Preliminary Report on Patentability dated May 8, 2026 for corresponding International Application No. PCT/US2024/055609.

* cited by examiner

ROTATABLE APPARATUSES AND METHODS OF OPERATING THE SAME

CROSS-REFERENCE TO RELATED APPLICATION

This application claims priority to and the benefit of U.S. Provisional Patent Application No. 63/599,759 filed in the United States Patent and Trademark Office on Nov. 16, 2023, the entire contents of which are incorporated herein by reference.

BACKGROUND

Field

The present inventive concepts relate to machines (also referred to herein interchangeably as apparatuses) for filling containers with a quantity of material articles, and in particular to machines for providing a particular quantity of material articles into each of a plurality of containers, and/or methods of operating such machines.

Description of Related Art

In manufacturing of containers filled with material products, including for example plant material products (e.g., oral products), machines may be used to fill each of a plurality of containers with a number (quantity) of material articles that may contain such material products (e.g., pouches containing plant material products).

In some cases, one or more lanes of containers may be indexed to a particular receiving position under a dispensing machine that indexes one or more sets of material articles into a container located in the receiving position to provide a particular number of material articles into the container in the receiving position.

SUMMARY

Example embodiments relate to rotatable apparatuses, packaging machines including same, and/or methods of operating the rotatable apparatuses and/or the packaging machines.

According to some example embodiments, a rotatable apparatus may include a rotatable drum and a rotatable turret. The rotatable drum may have a first central rotation axis and including a circumferential pattern of a plurality of funnels having rotational symmetry around the first central rotation axis. Each funnel of the plurality of funnels may define a top opening at a top end of the rotatable drum and a bottom opening at a bottom end of the rotatable drum. The rotatable turret may be rotationally fixed to the rotatable drum. The rotatable turret may include a circumferential plurality of arms having rotational symmetry around the first central rotation axis and at least partially defining a plurality of recesses that have rotational symmetry around the first central rotation axis and axially overlap separate, respective funnel bottom openings of the plurality of funnels of the rotatable drum.

Two azimuthally adjacent funnels of the plurality of funnels may define respective two azimuthally adjacent top openings having different intrinsic shapes.

One top opening of the respective two azimuthally adjacent top openings may be azimuthally symmetric.

One top opening of the respective two azimuthally adjacent top openings may be azimuthally asymmetric.

The respective two azimuthally adjacent top openings may at least partially overlap in a radial direction extending radially from the first central rotation axis.

Each top opening of the respective two azimuthally adjacent top openings may define at least one first azimuthal area and at least one second azimuthal area that is partially azimuthally adjacent to the at least one first azimuthal area. The at least one first azimuthal area may have a greater radial width than the at least one second azimuthal area. At least one second azimuthal area of one of the respective two azimuthally adjacent top openings may at least partially overlap at least one second azimuthal area of another one of the respective two azimuthally adjacent top openings in the radial direction.

A first azimuthal area of at least one top opening of the respective two azimuthally adjacent top openings may have a first radial width that is a radial width between a radially outermost inner surface and a radially innermost inner surface of the at least one top opening. At least one second azimuthal area of the at least one top opening may have a second radial width that extends radially from one of the radially outermost inner surface or the radially innermost inner surface of the at least one top opening.

The plurality of funnels may include a set of funnels. The set of funnels may include a first funnel having a first funnel top opening, a second funnel having a second funnel top opening, and a third funnel having a third funnel top opening. The first funnel may be azimuthally between the second funnel and the third funnel. The first funnel top opening may be azimuthally symmetric. The second funnel top opening and the third funnel top opening may each be azimuthally asymmetric and have reflective azimuthal symmetry around an axis of symmetry that extends radially from the first central rotation axis.

The rotatable apparatus may include a plurality of air vent conduits extending from separate, respective bottom openings of the plurality of funnels to separate, respective recesses of the rotatable turret. Each air vent conduit may include one or more openings extending through a thickness of a cylindrical sidewall of the air vent conduit.

According to some example embodiments, a packaging machine may include the rotatable apparatus and an ejection system that is configured to eject separate pluralities of material articles at a fixed time interval.

The ejection system may include an ejection wheel and an ejection device. The ejection wheel may have a second central rotation axis. The ejection wheel may include a separate circumferential pattern of a plurality of ejection plates having respective outer surfaces facing radially outward from the second central rotation axis and collectively defining an outer cylindrical rim of the ejection wheel. Each ejection plate may define a plurality of cups open to an outer surface of the ejection plate. Each ejection plate may define one or more air conduits extending from each cup of the plurality of cups to an inner surface of the ejection plate facing radially inward toward the second central rotation axis. The ejection device may be fixed in position in relation to the ejection wheel. The ejection device may include a gas supply manifold having a gas discharge port defining an ejection position of the ejection device that is fixed in relation to the ejection wheel and may at least partially define a material receiving position of the rotatable apparatus overlapping the ejection device in a vertical direction extending in parallel to the first central rotation axis, such that the material receiving position is fixed in relation to the ejection device.

According to some example embodiments, a method of operating the packaging machine may include rotating the rotatable apparatus around the first central rotation axis at a first rate of rotation to continuously move the plurality of funnels through a material receiving position and to cause the rotatable turret to cause a plurality of containers to move continuously along an arcuate path while axially aligned with separate, respective bottom openings of the plurality of funnels. The method may include operating the ejection system to eject the separate pluralities of material articles into the material receiving position concurrently with the rotatable apparatus rotating around the first central rotation axis at the first rate of rotation.

The ejection system may include an ejection wheel and an ejection device. The ejection wheel may have a second central rotation axis. The ejection wheel may include a separate circumferential pattern of a plurality of ejection plates having respective outer surfaces facing radially outward from the second central rotation axis and collectively defining an outer cylindrical rim of the ejection wheel. Each ejection plate may define a plurality of cups open to an outer surface of the ejection plate. Each ejection plate may define one or more air conduits extending from each cup of the plurality of cups to an inner surface of the ejection plate facing radially inward toward the second central rotation axis. The ejection device may be fixed in position in relation to the ejection wheel. The ejection device may include a gas supply manifold having a gas discharge port defining an ejection position of the ejection device that is fixed in relation to the ejection wheel and may at least partially define a material receiving position of the rotatable apparatus overlapping the ejection device in a vertical direction extending in parallel to the first central rotation axis, such that the material receiving position is fixed in relation to the ejection device. The operating the ejection system may include rotating the ejection wheel around the second central rotation axis at a second rate of rotation to continuously move the plurality of ejection plates through the ejection position concurrently with operating the ejection device to direct a gas through the gas discharge port at the ejection position, to cause the gas to be directed into one or more cups of one or more ejection plates of the plurality of ejection plates based on the one or more ejection plates moving through the ejection position.

According to some example embodiments, a packaging machine may include a rotatable apparatus and an ejection system. The rotatable apparatus may be configured to rotate a circumferential pattern of a plurality of funnels around a first central rotation axis at a first rate of rotation concurrently with a plurality of containers moving continuously along an arcuate path while axially aligned with separate, respective bottom openings of the plurality of funnels. The ejection system may be configured to eject separate pluralities of material articles from a fixed ejection position at a fixed time interval. The rotatable apparatus may be configured to direct a same quantity of the material articles into each of the plurality of containers based on the rotatable apparatus rotating the plurality of funnels around the first central rotation axis at the first rate of rotation such that each separate funnel of the plurality of funnels moves continuously through a material receiving position that is fixed in relation to the ejection system concurrently with the rotatable apparatus receiving at least one of the separate pluralities of material articles at the material receiving position.

The ejection system may be configured to eject each separate plurality of material articles as a linear pattern of material articles aligned with a radial direction extending radially from the first central rotation axis and intersecting the material receiving position, the radial direction fixed in relation to the ejection system. The rotatable apparatus may be configured to direct separate portions of at least one linear pattern of material articles received at the material receiving position into different, azimuthally adjacent funnels of the plurality of funnels at least partially simultaneously located at the material receiving position.

The rotatable apparatus may be configured to direct the separate portions of the at least one linear pattern of material articles into the different, azimuthally adjacent funnels according to respective radial proximities of the separate portions to the first central rotation axis.

The plurality of funnels may include a set of funnels. The set of funnels may include a first funnel having a first funnel top opening, a second funnel having a second funnel top opening, and a third funnel having a third funnel top opening. The first funnel may be azimuthally between the second funnel and the third funnel. The first funnel top opening may be azimuthally symmetric. The second funnel top opening and the third funnel top opening may each be azimuthally asymmetric and may have reflective azimuthal symmetry around an axis of symmetry that extends radially from the first central rotation axis.

The rotatable apparatus may be configured to direct each material article received into each separate funnel of the plurality of funnels into a separate air vent conduit such that air displaced by the material article moving through the separate air vent conduit is vented externally to the separate air vent conduit through one or more openings extending through a thickness of a cylindrical sidewall of the separate air vent conduit.

The ejection system may include an ejection wheel and an ejection device. The ejection wheel may have a second central rotation axis. The ejection wheel may include a separate circumferential pattern of a plurality of ejection plates having respective outer surfaces radially outward from the second central rotation axis and collectively defining an outer cylindrical rim of the ejection wheel. Each ejection plate may define a plurality of cups open to an outer surface of the ejection plate. The ejection device may define an ejection position that is fixed in position in relation to the ejection wheel, the ejection device configured to cause material articles held in the plurality of cups of each ejection plate to be ejected from the ejection system based on the ejection wheel rotating the ejection plate through the ejection position.

A ratio of the same quantity of material articles to a quantity of material articles in each separate plurality of material articles may be a rational number and may be neither an integer nor a fraction 1/x where x is an integer.

The rotatable apparatus may be configured to direct separate portions of at least one plurality of material articles ejected by the ejection system into different, azimuthally adjacent funnels at least partially simultaneously located at the material receiving position.

The rotatable apparatus may be configured to direct the separate portions of the at least one plurality of material articles into the different, azimuthally adjacent funnels according to respective radial proximities of the separate portions to the first central rotation axis.

According to some example embodiments, a method may include rotating a rotatable apparatus including a circumferential pattern of a plurality of funnels around a first central rotation axis at a first rate of rotation to cause a plurality of containers to be moved continuously along an arcuate path while axially aligned with separate, respective bottom openings of separate, respective funnels the plurality of funnels. The method may include operating an ejection system to eject separate pluralities of material articles at a fixed time interval concurrently with the rotatable apparatus rotating around the first central rotation axis at the first rate of rotation, such that the rotatable apparatus directs each separate plurality of material articles into one or more containers of the plurality of containers via one or more funnels of the plurality of funnels while maintaining continuous movement of the plurality of containers along the arcuate path.

The ejection system may include an ejection wheel and an ejection device. The ejection wheel may have a second central rotation axis. The ejection wheel may include a separate circumferential pattern of a plurality of ejection plates having respective outer surfaces facing radially outward from the second central rotation axis and collectively defining an outer cylindrical rim of the ejection wheel. Each ejection plate may define a plurality of cups open to an outer surface of the ejection plate. Each ejection plate may define one or more air conduits extending from each cup of the plurality of cups to an inner surface of the ejection plate facing radially inward toward the second central rotation axis. The ejection device may be configured to eject material articles from each ejection plate of the ejection wheel at an ejection position that is fixed in relation to the ejection wheel and at least partially defines a material receiving position of the rotatable apparatus overlapping the ejection device in a vertical direction extending in parallel to the first central rotation axis, such that the material receiving position is fixed in relation to the ejection device. The operating the ejection system may include rotating the ejection wheel around the second central rotation axis at a second rate of rotation to continuously move the plurality of ejection plates through the ejection position concurrently with operating the ejection device to direct a gas through a gas discharge port at the ejection position, to cause the gas to be directed into one or more cups of one or more ejection plates of the plurality of ejection plates based on the one or more ejection plates moving through the ejection position.

Each separate plurality of material articles ejected by the ejection system may be a linear pattern of material articles aligned with a radial direction extending radially from the first central rotation axis and intersecting a material receiving position of the rotatable apparatus. The operating the ejection system to eject the separate pluralities of material articles at the fixed time interval concurrently with the rotatable apparatus rotating around the first central rotation axis at the first rate of rotation may cause separate portions of at least one linear pattern of material articles received at the material receiving position to be directed by the rotatable apparatus into different, azimuthally adjacent funnels of the plurality of funnels at least partially simultaneously located at the material receiving position.

The operating the ejection system to eject the separate pluralities of material articles at the fixed time interval concurrently with the rotatable apparatus rotating around the first central rotation axis at the first rate of rotation may cause the separate portions of the at least one linear pattern of material articles to be directed by the rotatable apparatus into the different, azimuthally adjacent funnels according to respective radial proximities of the separate portions to the first central rotation axis.

The operating the ejection system to eject the separate pluralities of material articles at the fixed time interval concurrently with the rotatable apparatus rotating around the first central rotation axis at the first rate of rotation may cause a same quantity of materials to be directed into separate, respective containers axially aligned under separate, respective funnels of the plurality of funnels, such that a ratio of the same quantity of material articles to a quantity of material articles in each separate plurality of material articles is a rational number and is neither an integer nor a fraction 1/x where x is an integer.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION

Figure 1A:
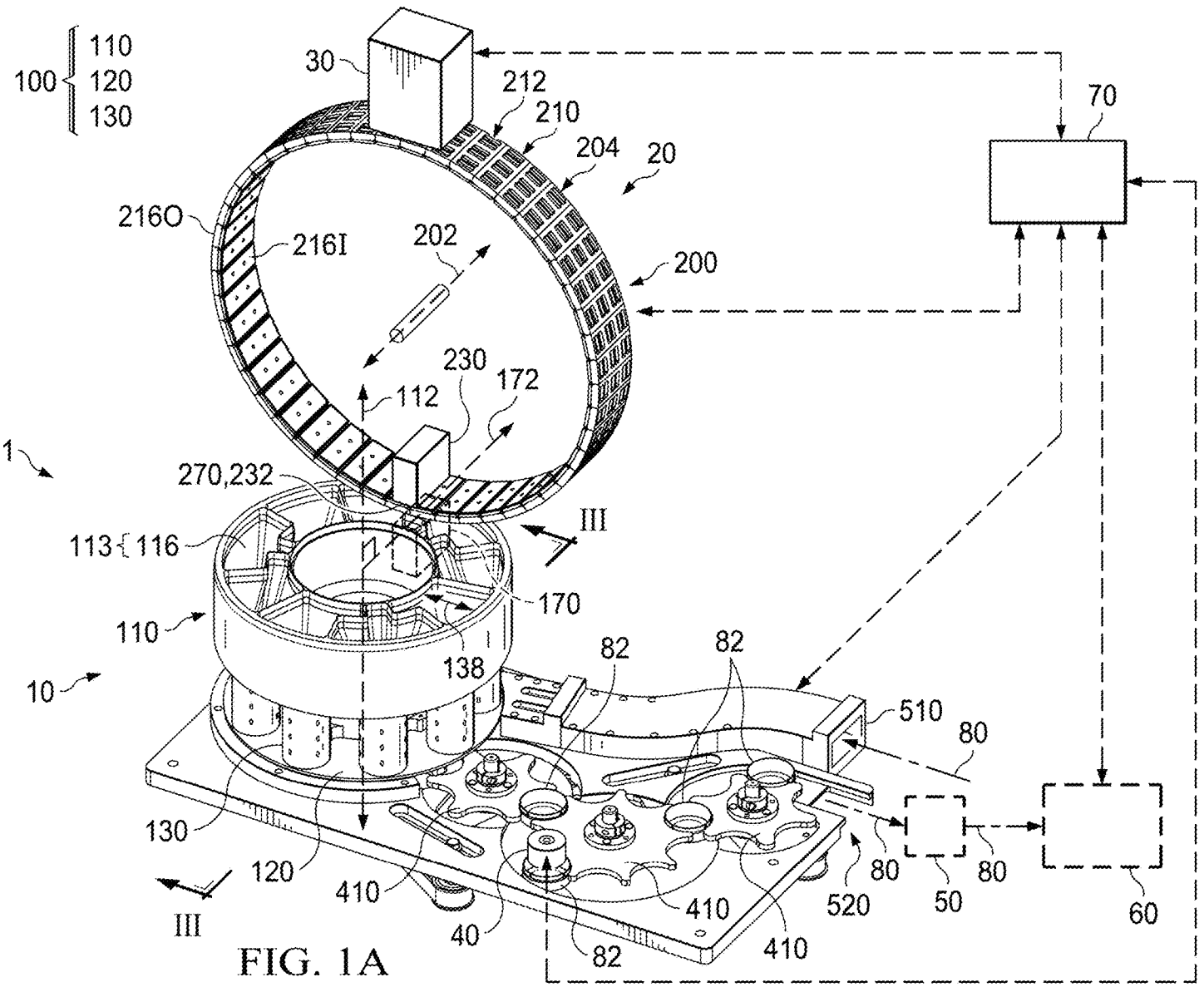
FIG. 1A is a top perspective view of a packaging machine according to some example embodiments.

Some detailed example embodiments are disclosed herein. However, specific structural and functional details disclosed herein are merely representative for purposes of describing example embodiments. Example embodiments may, however, be embodied in many alternate forms and should not be construed as limited to only the example embodiments set forth herein.

Accordingly, while example embodiments are capable of various modifications and alternative forms, example embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives falling within the scope of example embodiments. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, regions, layers and/or sections, these elements, regions, layers, and/or sections should not be limited by these terms. These terms are only used to distinguish one element, region, layer, or section from another region, layer, or section. Thus, a first element, region, layer, or section discussed below could be termed a second element, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various example embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, and/or elements, but do not preclude the presence or addition of one or more other features, integers, steps, operations, elements, and/or groups thereof.

Example embodiments are described herein with reference to cross-sectional illustrations that are schematic illustrations of example embodiments. As such, variations from the shapes of the illustrations are to be expected. Thus, example embodiments should not be construed as limited to the shapes of regions illustrated herein but are to include deviations and variations in shapes.

It will be understood that when an element such as a layer, film, region, or substrate is referred to as being "on" another element, it may be directly on the other element or intervening elements may also be present. In contrast, when an element is referred to as being "directly on" another element, there are no intervening elements present. It will further be understood that when an element is referred to as being "on" another element, it may be above or beneath or adjacent (e.g., horizontally adjacent) to the other element.

It will be understood that elements and/or properties thereof (e.g., structures, surfaces, directions, or the like), which may be referred to as being "perpendicular," "parallel," "coplanar," or the like with regard to other elements and/or properties thereof (e.g., structures, surfaces, directions, or the like) may be "perpendicular," "parallel," "coplanar," or the like or may be "substantially perpendicular," "substantially parallel," "substantially coplanar," respectively, with regard to the other elements and/or properties thereof.

Elements and/or properties thereof (e.g., structures, surfaces, directions, or the like) that are "substantially perpendicular", "substantially parallel", or "substantially coplanar" with regard to other elements and/or properties thereof will be understood to be "perpendicular", "parallel", or "coplanar", respectively, with regard to the other elements and/or properties thereof within manufacturing tolerances and/or material tolerances and/or have a deviation in magnitude and/or angle from "perpendicular", "parallel", or "coplanar", respectively, with regard to the other elements and/or properties thereof that is equal to or less than 10% (e.g., a. tolerance of +10%).

It will be understood that elements and/or properties thereof may be recited herein as being "the same" or "equal" as other elements, and it will be further understood that elements and/or properties thereof recited herein as being "identical" to, "the same" as, or "equal" to other elements may be "identical" to, "the same" as, or "equal" to or "substantially identical" to, "substantially the same" as or "substantially equal" to the other elements and/or properties thereof. Elements and/or properties thereof that are "substantially identical" to, "substantially the same" as or "substantially equal" to other elements and/or properties thereof will be understood to include elements and/or properties thereof that are identical to, the same as, or equal to the other elements and/or properties thereof within manufacturing tolerances and/or material tolerances. Elements and/or properties thereof that are identical or substantially identical to and/or the same or substantially the same as other elements and/or properties thereof may be structurally the same or substantially the same, functionally the same or substantially the same, and/or compositionally the same or substantially the same. While the term "same," "equal" or "identical" may be used in description of some example embodiments, it should be understood that some imprecisions may exist. Thus, when one element is referred to as being the same as another element, it should be understood that an element or a value is the same as another element within a desired manufacturing or operational tolerance range (e.g., ±10%).

It will be understood that elements and/or properties thereof described herein as being "substantially" the same and/or identical encompasses elements and/or properties thereof that have a relative difference in magnitude that is equal to or less than 10%. Further, regardless of whether elements and/or properties thereof are modified as "substantially," it will be understood that these elements and/or properties thereof should be construed as including a manufacturing or operational tolerance (e.g., +10%) around the stated elements and/or properties thereof.

When the terms "about" or "substantially" are used in this specification in connection with a numerical value, it is intended that the associated numerical value includes a manufacturing or operational tolerance (e.g., ±10%) around the stated numerical value. Moreover, when the words "about" and "substantially" are used in connection with geometric shapes, it is intended that precision of the geometric shape is not required but that latitude for the shape is within the scope of the disclosure. Further, regardless of whether numerical values or shapes are modified as "about" or "substantially," it will be understood that these values and shapes should be construed as including a manufacturing or operational tolerance (e.g., ±10%) around the stated numerical values or shapes. When ranges are specified, the range includes all values therebetween such as increments of 0.1%.

As described herein, when an operation is described to be performed, or an effect such as a structure is described to be established "by" or "through" performing additional operations, it will be understood that the operation may be performed and/or the effect/structure may be established "based on" the additional operations, which may include performing said additional operations alone or in combination with other further additional operations.

As described herein, an element that is described to be "spaced apart" from another element, in general and/or in a particular direction (e.g., vertically spaced apart, laterally spaced apart, etc.) and/or described to be "separated from" the other element, may be understood to be isolated from direct contact with the other element, in general and/or in the particular direction (e.g., isolated from direct contact with the other element in a vertical direction, isolated from direct contact with the other element in a lateral or horizontal direction, etc.). Similarly, elements that are described to be "spaced apart" from each other, in general and/or in a particular direction (e.g., vertically spaced apart, laterally spaced apart, etc.) and/or are described to be "separated" from each other, may be understood to be isolated from direct contact with each other, in general and/or in the particular direction (e.g., isolated from direct contact with each other in a vertical direction, isolated from direct contact with each other in a lateral or horizontal direction, etc.). Similarly, a structure described herein to be between two other structures to separate the two other structures from each other may be understood to be configured to isolate the two other structures from direct contact with each other.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

Hereinafter, a non-limiting example of a rotatable apparatus 100, a container filling system 10 including same, and a packaging machine 1 including same according to some example embodiments is described, but inventive concepts are not limited thereto.

Figure 1B:
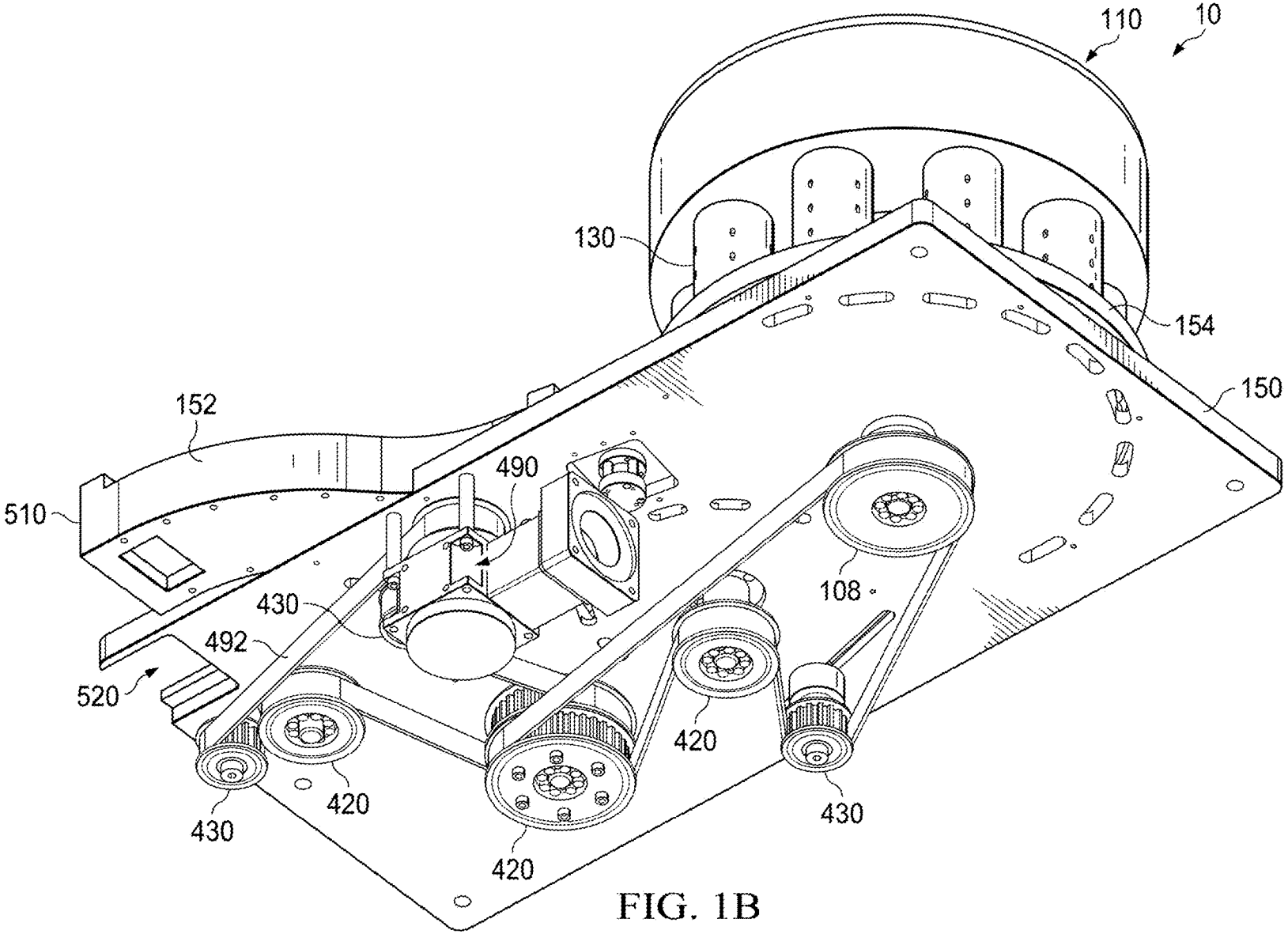
FIG. 1B is a bottom perspective view of the container filling system of FIG. 1A according to some example embodiments.
Figure 1C:
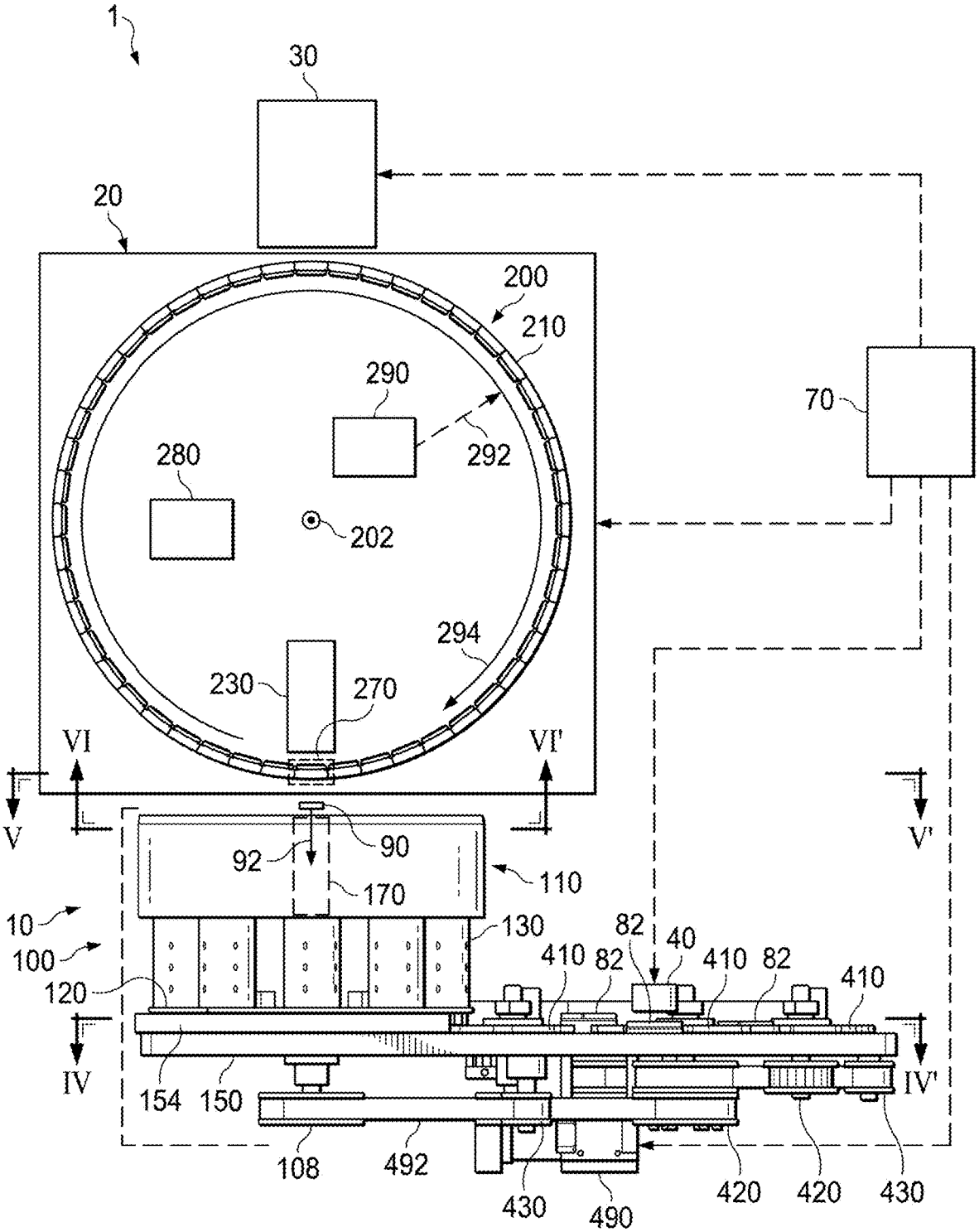
FIG. 1C is a plan view of the packaging machine of FIG. 1A according to some example embodiments.
Figure 2A:
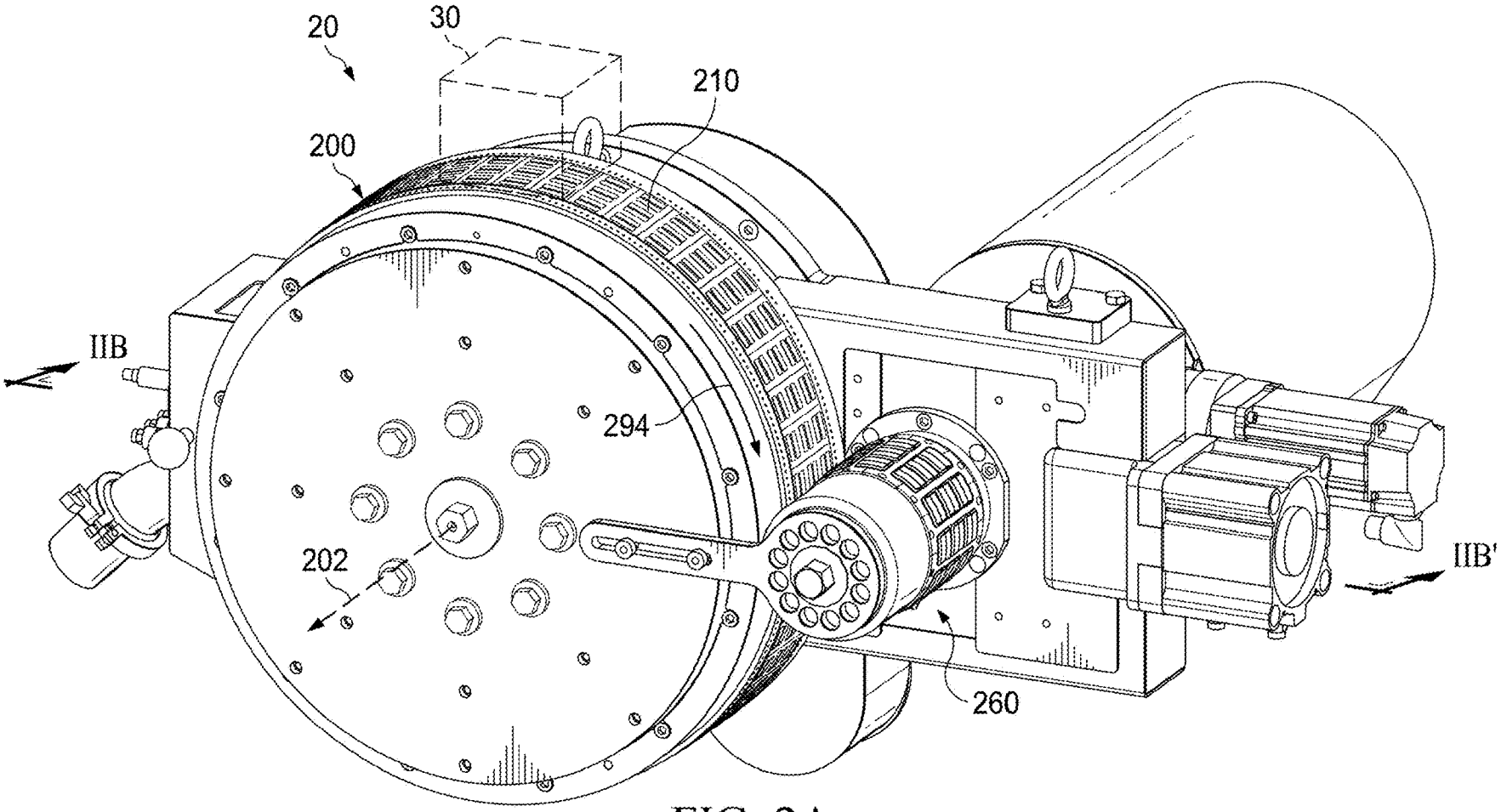
FIG. 2A is a perspective view of an ejection system according to some example embodiments.
Figure 2B:
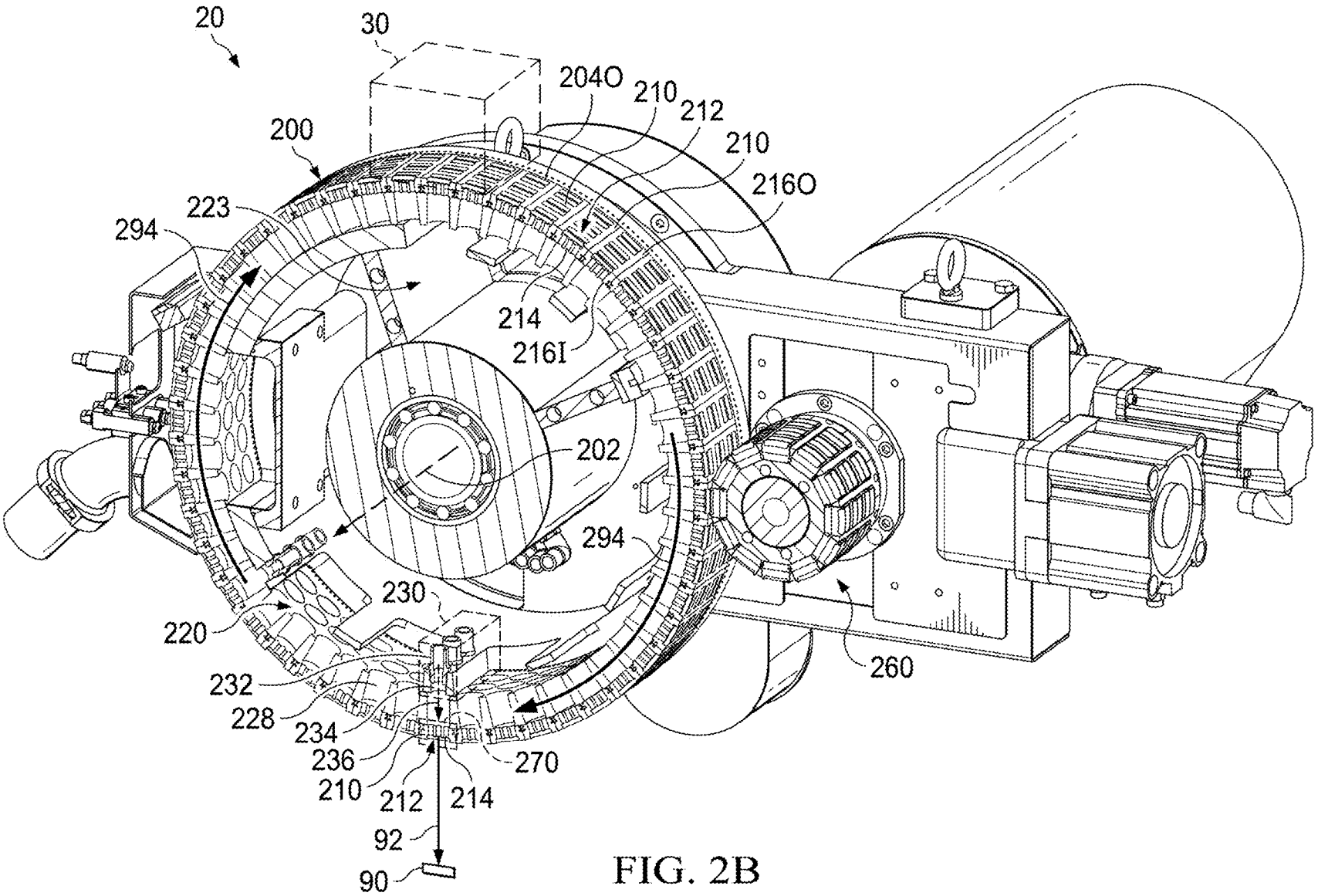
FIG. 2B is a perspective cross-sectional view of an ejection system along cross-sectional view line IIB-IIB' of FIG. 2A, according to some example embodiments.
Figure 3:
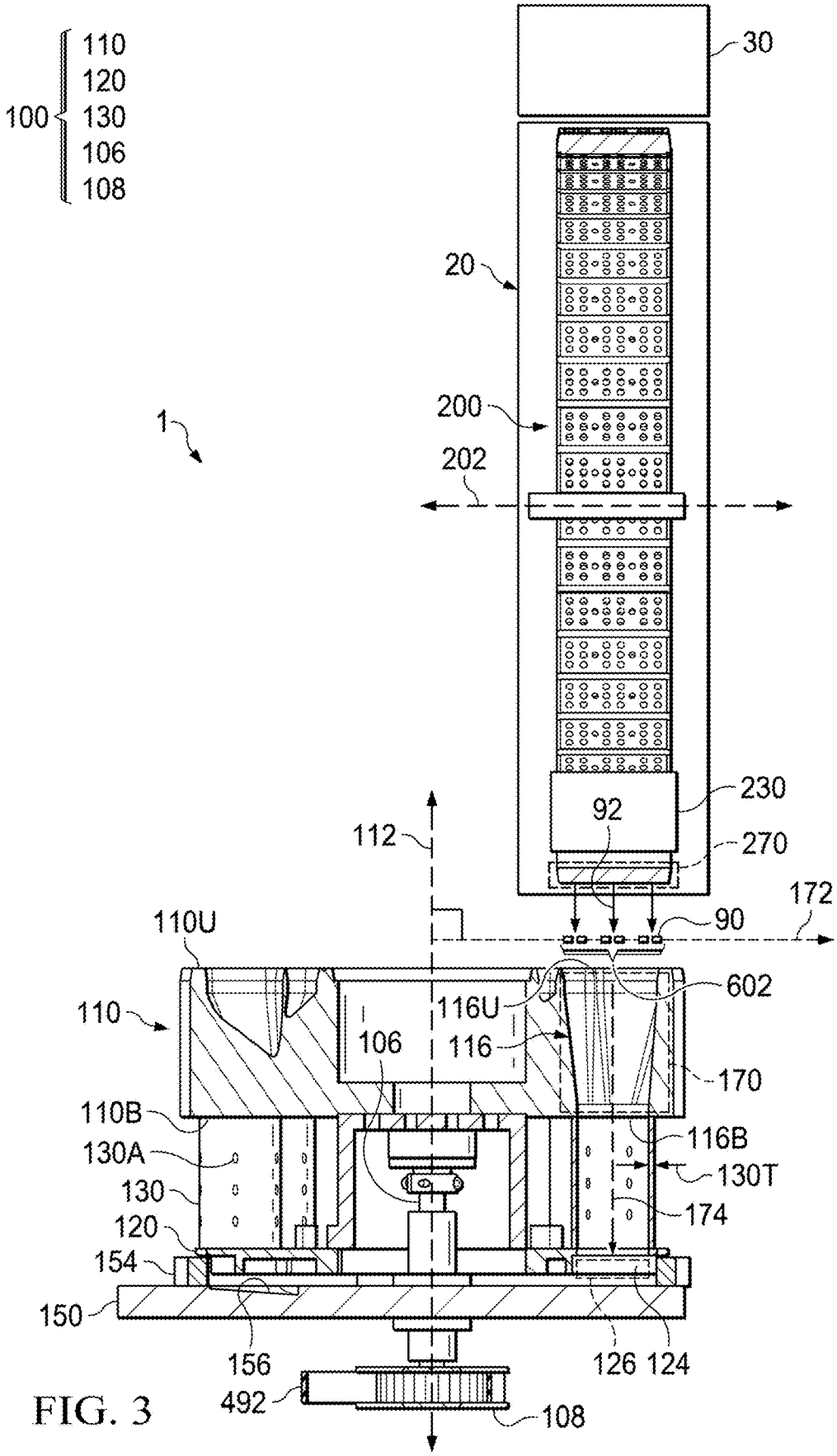
FIG. 3 is an elevation cross-sectional view along cross-sectional view line III-III' of FIG. 1A, according to some example embodiments.
Figure 4:
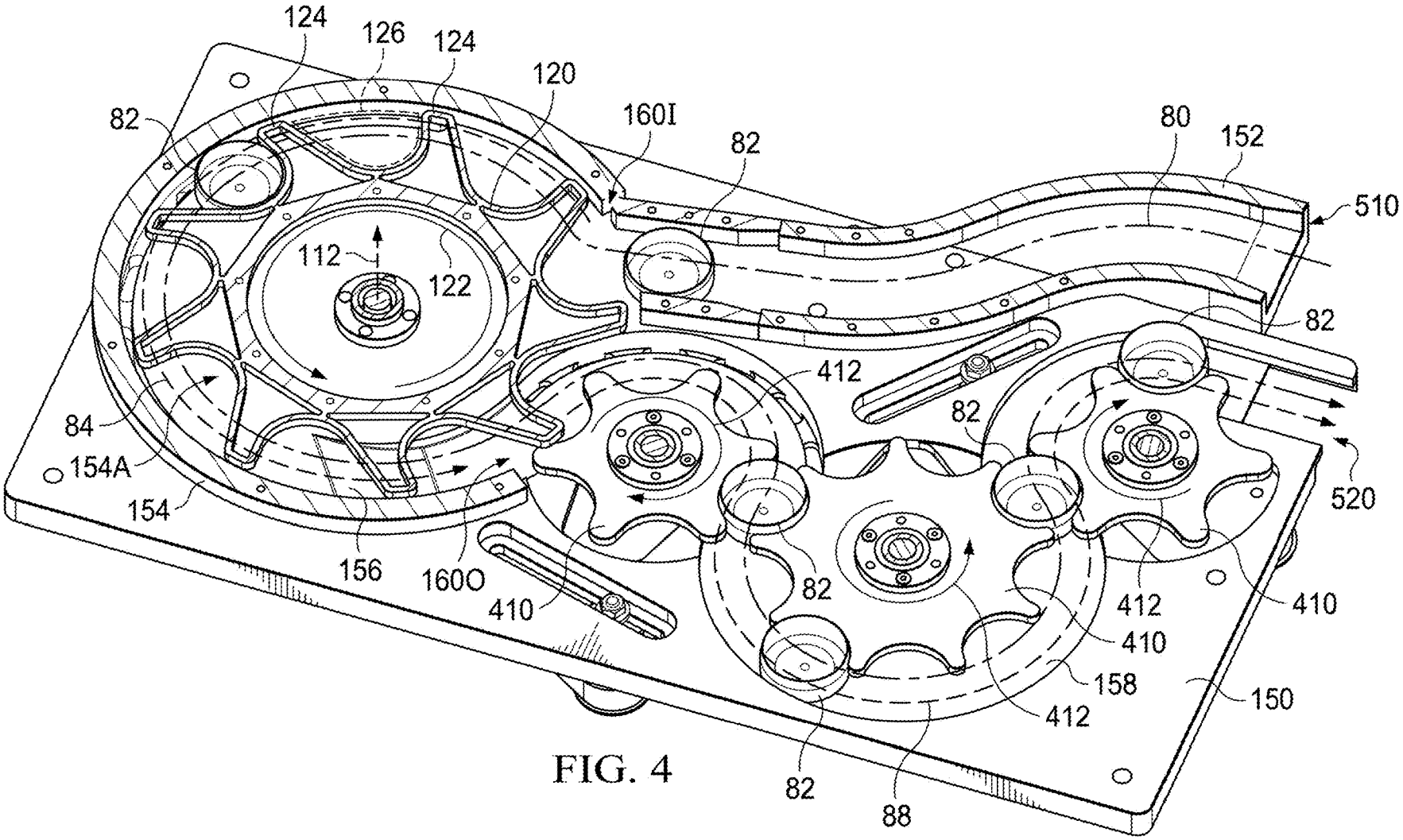
FIG. 4 is a perspective cross-sectional view along cross-sectional view line IV-IV' of FIG. 1C, according to some example embodiments.
Figure 5A:
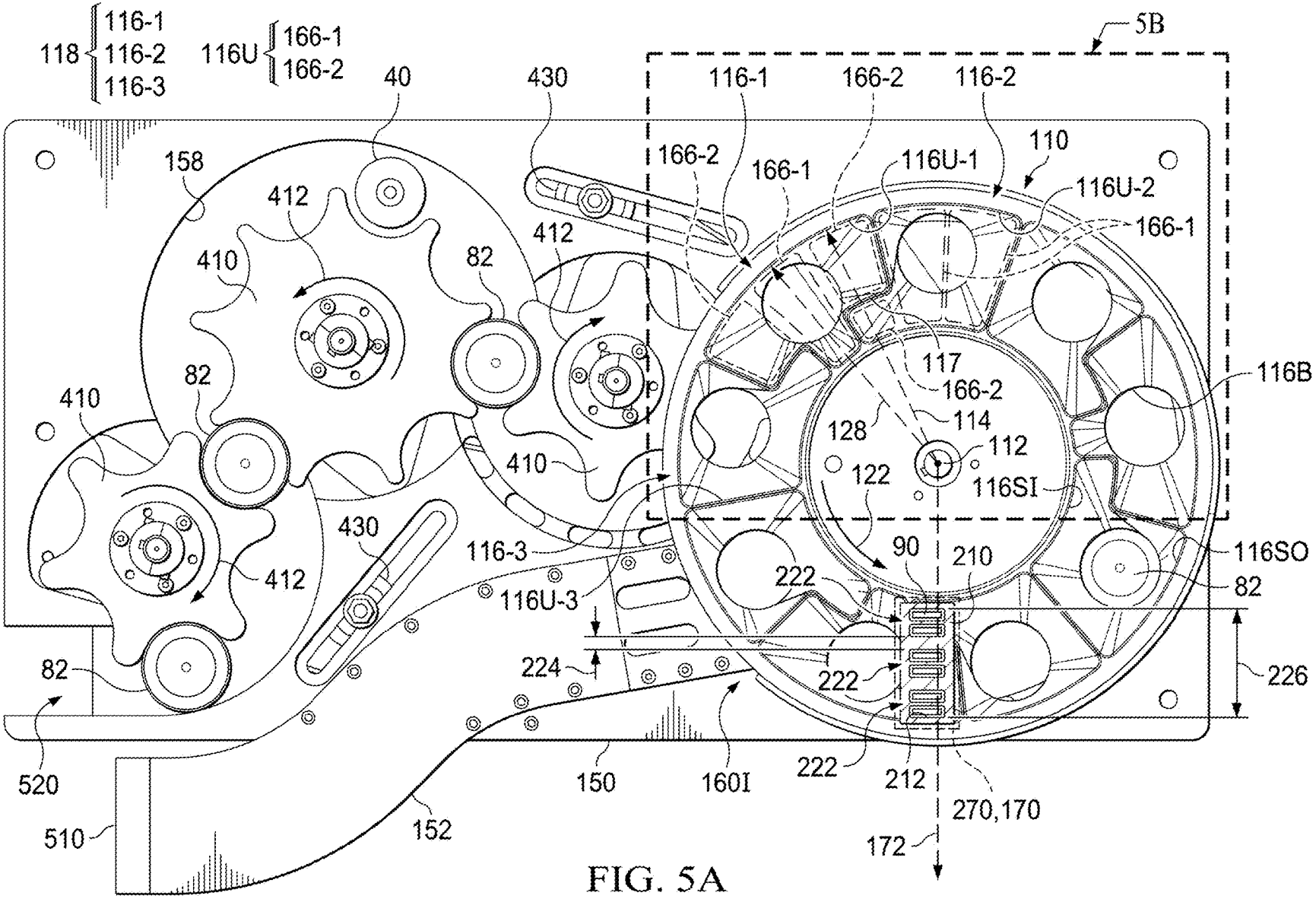
FIG. 5A is a top cross-sectional view along cross-sectional view line V-V' of FIG. 1C, according to some example embodiments.
Figure 5B:
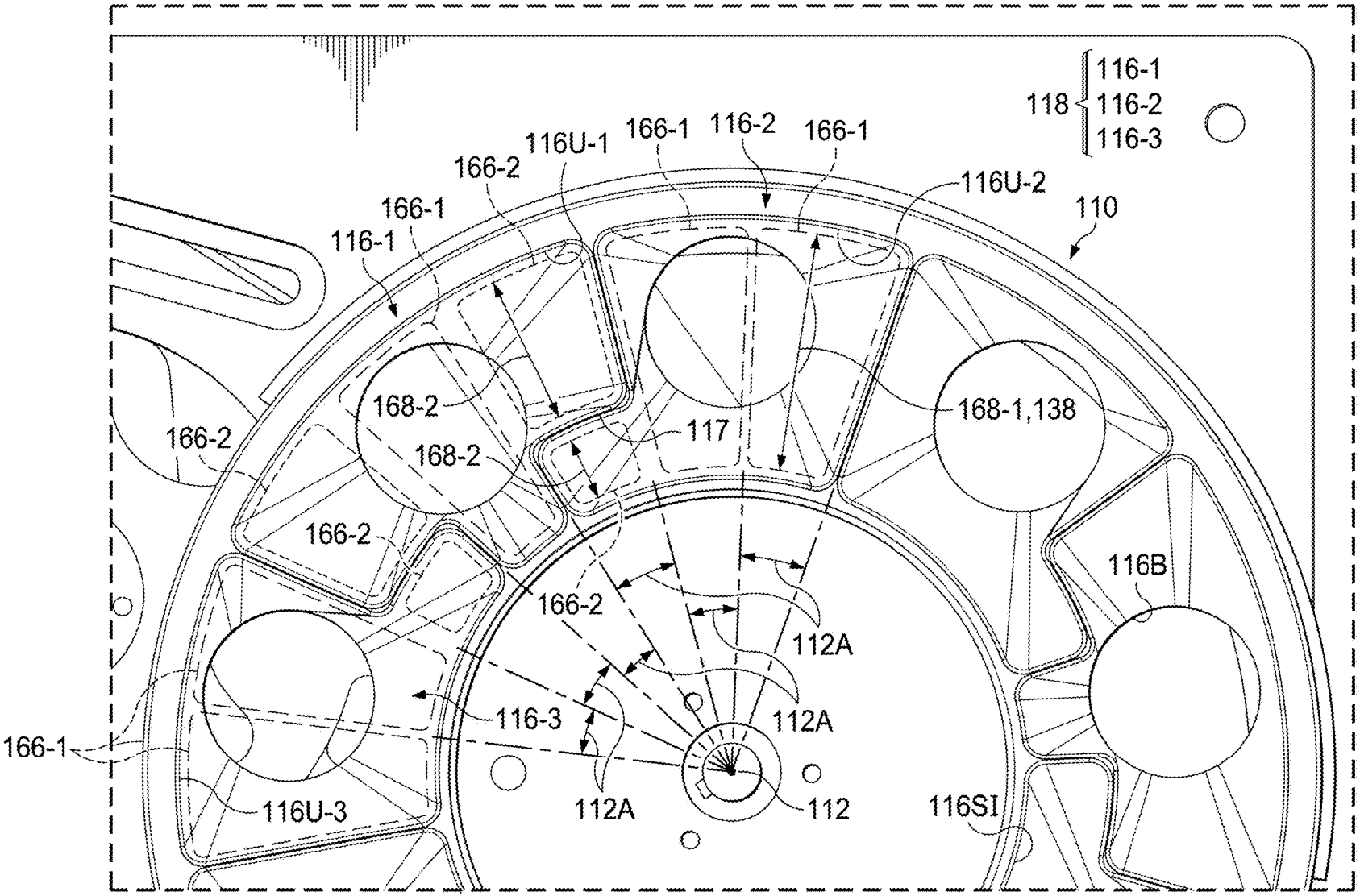
FIG. 5B is an expanded view of region 5B in FIG. 5A, according to some example embodiments.

FIG. 1A is a top perspective view of a packaging machine according to some example embodiments. FIG. 1B is a bottom perspective view of the container filling system of FIG. 1A according to some example embodiments. FIG. 1C is a plan view of the packaging machine of FIG. 1A according to some example embodiments. FIG. 2A is a perspective view of an ejection system according to some example embodiments. FIG. 2B is a perspective cross-sectional view of an ejection system along cross-sectional view line IIB-IIB' of FIG. 2A, according to some example embodiments. FIG. 3 is an elevation cross-sectional view along cross-sectional view line III-III' of FIG. 1A, according to some example embodiments. FIG. 4 is a perspective cross-sectional view along cross-sectional view line IV-IV' of FIG. 1C, according to some example embodiments. FIG. 5A is a top cross-sectional view along cross-sectional view line V-V' of FIG. 1C, according to some example embodiments. FIG. 5B is an expanded view of region 5B in FIG. 5A, according to some example embodiments.

Referring to FIGS. 1A to 1C, a packaging machine 1 may include a container filling system 10 and an ejection system 20. The ejection system 20 (also referred to herein interchangeably as a material article forming system, a pouch forming system, or the like) may be configured to receive, and/or at least partially form material articles 90 (e.g., pouches of material). The ejection system 20 may also be configured to eject 92 (e.g., dispense, discharge, etc.) the material articles 90 from the ejection system 20 at a particular, fixed ejection position 270 (also referred to herein as an ejection region, an ejection area, a "fixed" ejection position, a "fixed" ejection area, a "fixed" ejection region, etc.). The container filling system 10 may be configured to receive the material articles 90 from the ejection system 20 and to distribute the received material articles to fill each container of one or more containers 82 (also referred to herein interchangeably as one or more "cans") among a lane 80 of containers with a particular quantity of material articles 90 (herein referred to interchangeably as a same quantity of material articles, a fixed quantity of material articles, or the like). The container filling system 10 may be configured to direct one or more received material articles 90 to fill a container 82 while keeping the container 82 in continuous motion (e.g., in continuous motion at a particular fixed speed along an arcuate path), such that the packaging machine 1 (e.g., at least the container filling system 10) may be configured to cause the lane 80 of containers 82 to be in continuous motion while being filled with the particular quantity of material articles 90. For example, the container filling system 10 is configured to direct a particular quantity of material articles 90 into one or more containers 82 of a lane 80 that is caused to be in continuous motion (e.g., based on the container filling system 10 engaging and/or positioning the one or more containers 82 to be in continuous motion), instead of indexing one or more pluralities of material articles 90 into an indexed container 82 that is stationary at a particular material receiving position.

In some example embodiments, as described herein, the ejection system 20 is configured to index separate pluralities 602 of material articles 90 at a particular time interval (also referred to herein as a fixed time interval). The container filling system 10 may be configured to direct each indexed plurality 602 of material articles 90 into one or more containers 82 of the lane 80 while the lane 80, and thus the one or more containers 82, are in continuous motion. The container filling system 10 may be configured to fill one or more containers 82 in the lane 80 without indexing the lane 80 of containers 82 and instead maintaining continuous motion of the lane 80 at least while the containers 82 are being filled with one or more material articles 90, despite the ejection system 20 indexing separate pluralities 602 of the material articles 90 at a fixed time interval. As a result, the speed of the lane 80 of containers 82, and thus the throughput speed at which containers 82 in the lane 80 are filled with a particular quantity of material articles 90 by the container filling system 10, referred to herein as the "throughput rate" of the container filling system 10 and/or of the lane 80, can be adjustably controlled without limitation from indexing the lane 80 of containers 82, thereby enabling a higher throughput rate of filled containers by the container filling system 10. As a further result, the throughput rate of the lane 80 (e.g., the speed of the lane 80) may be increased, relative to example embodiments where the lane 80 is indexed to a fixed material receiving position where one or more pluralities of material articles 90 are indexed into a container 82 at the fixed material receiving position. Accordingly, manufacturing throughput of containers 82 filled with a particular quantity of material articles 90 may be improved, based on the container filling system 10 being configured to direct a particular quantity of material articles into the lane 80 of one or more containers 82 while maintaining continuous motion of the lane 80 of containers 82.

In addition, because the throughput rate of a single lane 80 may be increased, the number (quantity) of lanes 80 to provide a particular throughput rate of containers 82 filled with a particular quantity of material articles 90 (e.g., a particular throughput rate of "filled containers") from a single ejection system 20 may be reduced, relative to example embodiments of packaging machines that may index multiple lanes of containers in parallel to receive separate pluralities of indexed material articles from a single ejection system 20. For example, a single lane 80 of containers 82 directed to move continuously through the container filling system 10 such that the container filling system 10 fills containers 82 in the lane 80 while maintaining continuous motion of the containers 82 may have a throughput rate that is greater than a multiple (e.g., 2*x*, 3*x*) of respective throughput rates of individual indexed lanes of containers that are index to receive separate portions of indexed pluralities 602 from the ejection system 20 in parallel, and so the packaging machine 1 can replace multiple parallel, indexed lanes of containers with a single, continuously-moving lane 80 of containers 82, enabled based on providing the container filling system 10 according to some example embodiments, without compromising the throughput rate of filled containers 82.

Furthermore, because the number of lanes 80 may be reduced to a single continuously-moving lane 80, the amount of manufacturing equipment supporting the lanes 80 receiving material articles 90 from a given ejection system 20 of the packaging machine 1 may be reduced, minimized, or omitted, thereby further reducing manufacturing capital costs, physical size, and/or operational feedback latency of the packaging machine 1. For example, the packaging machine 1 may enable a manufacturing system that fills, seals, and weighs containers to have a single, continuously-moving lane 80 of containers 82 that are filled by the container filling system 10 with material articles 90 ejected from a single ejection system 20 and subsequently packed, sealed, and weighed (e.g., weighed by a weight checking system 60 as described herein). The weight checking system 60 can enable the packaging machine 1 to implement a feedback loop to adjust operating speed of the ejection system 20 and/or the container filling system 10 to adjust or fine-tune the weight of the filled containers 82 to approach or remain within a target weight range (e.g., based on adjusting the quantity of material articles 90 directed into the containers as a function of the operational speed of the ejection system 20 and/or the container filling system 10). A packaging machine 1 that includes the container filling system 10 may be configured to enable a continuously-moving lane 80 of containers 82 to be filled with material articles 90 ejected from a single ejection system 20, such that the single, continuously-moving lane 80 may replace multiple (e.g., three) parallel indexed lanes receiving material articles indexed from the ejection system 20. As a result, manufacturing equipment to merge the multiple lanes downstream of the container filling system 10 (in order to avoid redundancy in downstream manufacturing machinery such as packing, sealing, and check-weighing equipment) may be avoided or omitted, or redundant equipment to support multiple parallel lanes may be avoided or omitted.

In addition, based on the container filling system 10 enabling a continuously-moving lane 80 of containers 82 that may be continuously packed, sealed, and weighed without merging multiple indexed lanes of filled containers 82, the weight checking system 60 may be positioned closer to the downstream end of the container filling system 10, thereby reducing the quantity of filled containers upstream of the weight checking system 60 (e.g., 15-18 filled containers, instead of approximately 100-110 filled containers in example embodiments where multiple, parallel indexed lanes of filled containers are merged together upstream of the weight checking system 60). As a result, the packaging machine 1 may be configured to enable quicker detection and/or feedback control of the packaging machine 1 based on sensor data generated by the weight checking system 60 that weighs filled containers 82, thereby enabling more agile adaptation, adjustability, operational feedback control, and/or correction of packaging machine operation, and thereby enabling more reliable manufacture of containers that are consistently filled with a particular quantity of material articles.

Still referring to FIGS. 1A-1C and further referring to FIGS. 2A-2B, the ejection system 20 may include an ejection wheel 200 having a second central rotation axis 202 (also referred to herein as a separate central rotation axis, a second central longitudinal axis, a second central axis of rotation, or the like). The ejection wheel 200 may include a circumferential plurality of ejection plates 210 having respective outer surfaces 2160 facing radially outward from the second central rotation axis 202 and collectively defining an outer cylindrical rim 2040 of the ejection wheel 200. As described herein, the circumferential plurality of ejection plates 210 may be referred to interchangeably as a plurality of ejection plates 210, a circumferential pattern of a plurality of ejection plates 210, a separate circumferential pattern of a plurality of ejection plates 210, or the like. As shown, each separate ejection plate 210 may define (e.g., include) a plurality of cups 212 that are each an open enclosure that is open to the outer surface 2160 of the ejection plate 210. Each ejection plate 210 may further define one or more conduits 214 extending from each separate cup 212 to an inner surface 2161 of the ejection plate 210 facing radially inward toward the second central rotation axis 202. As shown, the ejection wheel 200 (including at least the circumferential plurality of ejection plates 210) may be mechanically coupled 292 (e.g., via any known drive transmission) to a drive motor 290 (e.g., any known motor, electrical motor, servomotor, or the like). The ejection wheel 200 may be configured to rotate 294 (e.g., clockwise as shown in at least FIGS. 1A, 1C, and 2B) around the second central rotation axis 202, based on operation of the drive motor 290. As further shown in at least FIG. 2B, the ejection wheel 200 may include an inner wheel 220 having conduits 228 extending therethrough, where the ejection plates 210 may be connected to an outer surface of the inner wheel 220 and the conduits 228 may establish fluid communication between the conduits 214 of the cups 212 of the ejection plates 210 and an inner enclosure 223 of the ejection system 20 that is surrounded by the ejection wheel 200. The inner wheel 220 may be mechanically coupled 292 to the drive motor 290, and the ejection plates 210 may be coupled to the drive motor 290 via connection to the inner wheel 220. In some example embodiments, the inner wheel 220 may be omitted. While the ejection plates 210 are each shown herein to include a plurality of cups 212 (e.g., six cups 212 per ejection plate 210), it will be understood that each ejection plate 210 may include any quantity of cups 212, including example embodiments where each ejection plate 210 includes a single cup 212.

Still referring to FIGS. 1A-1C and FIGS. 2A-2B, the packaging machine 1 may include a material dispenser apparatus 30 (e.g., doser apparatus, filler dispenser, etc.) that may be located at a fixed position in relation to the ejection wheel 200. For example, as shown, the material dispenser apparatus 30 may be located at a fixed position above the ejection wheel 200. For example, the material dispenser apparatus 30 may be located at a top position as shown in FIGS. 1A, 1C, and 2A-2B (also referred to herein as a 6 o-clock position), so that the respective cups 212 of ejection plates 210 of the ejection wheel 200 may be facing upwards to the material dispenser apparatus 30 when at a closest proximity to the material dispenser apparatus 30. The packaging machine 1 may be configured to direct a first (bottom) mesh material to line the outer surfaces 2160 and an inner surface of the cups 212 of an ejection plate 210 at the 6 o-clock position, cause the material dispenser apparatus 30 to fill the mesh-lined cups 212 of the ejection plate 210 at the 6 o-clock position with a material (e.g., a plant material, granular material, etc.), seal the top of the filled cups 212 with a second (top) mesh material that may be sealed (joined, adhered, etc.) to the first (lower) mesh material lining the bottom inner surface of the cups 212, and operate a machine 260 (e.g., a bonding/cutting machine, a heat knife assembly, or the like) to counter rotate in synchronization with the ejection wheel 200 to bond the top and bottom mesh materials around each cup 212 and sever the bonded meshes surrounding the material in the cups 212 from remainder (scrap) mesh outside the cups 212 in order to form a material article 90 of material (e.g., a pouch of material, a mesh pouch of material, etc.) in each cup 212 of each ejection plate 210 at least at the position of the machine 260. Based on the ejection wheel 200 rotating 294 around the second central rotation axis 202, ejections plates 210 may move to the 6 o-clock position and be lined with a bottom mesh and filled with material that is then sealed into mesh material(s) to form material articles (pouches) in the cups 212 of the ejection plates 210.

The ejection system 20 may include a vacuum system 280 which may include a vacuum pump (e.g., any known vacuum system, vacuum pump, etc.), that may induce a reduced pressure or vacuum in the inner enclosure 223 of the ejection system 20 that is surrounded by the ejection wheel 200, where as shown the inner enclosure 223 may be a closed enclosure that is configured to support a vacuum or reduced pressure in relation to an ambient atmospheric pressure external to the ejection system 20. It will be understood that a reduced pressure or vacuum in the inner enclosure 223 and any other portion of the ejection system 20 may be referred to herein as simply a "vacuum," but a "vacuum" as described herein in an enclosure may refer to any reduction in pressure in the enclosure in relation to the ambient atmospheric pressure.

The inner surfaces 2161 of the ejection plates 210 of the ejection wheel 200, and thus the conduits 214 establishing fluid communication between the inner surfaces 2161 and the cups 212 of the ejection plates 210, may be selectively exposed to or isolated from the inner enclosure 223 (and the vacuum therein) based on the position of the ejection plates 210 as the ejection wheel 200 rotates 294. When an inner surface 2161 of an ejection plate 210 is exposed to the inner enclosure 223, the vacuum in the inner enclosure 223 as induced by the vacuum system 280 may induce a suction force from the cups and through the exposed conduits 214 of an ejection plate 210 to hold any mesh or material article located in a cup 212, of the ejection plate 210 to which the exposed conduits 214 extend, against the inner surface of the cup 212. As a result, the exposure of an inner surface 2161 of an ejection plate 210 to the vacuum of the inner enclosure 223 may prevent the material articles 90 and/or mesh in the cups 212 of the ejection plates 210 from being ejected from, or falling out, of the cups 212 as the ejection wheel 200 rotates 294 to move the outer surfaces 2160 of the ejection plates 210 to face downwards in the direction of gravity (e.g., as the ejection wheel 200 rotates a given ejection plate 210 holding one or more material articles 90 in one or more cups 212 thereof towards the ejection position 270 as described herein).

The ejection system 20 may include an ejection device 230 that is fixed in position in relation to the ejection wheel 200 (e.g., fixed in position in relation to the ejection system 20, the packaging machine 1, the container filling system 10, or the like). The ejection device 230 may be configured to cause material articles 90 held in cups 212 of the ejection wheel 200 to be ejected from the ejection plates 210, and thus from the ejection system, based on the ejection plates 210 moving (e.g., continuously moving at a fixed speed) through a fixed ejection position. The ejection device 230 may be configured to supply a gas into the cup(s) 212 of an ejection plate 210 that is at the ejection position 270 to push material articles 90 held therein to be ejected 92 out of the cup(s) 212 and thus out of the ejection system 20. For example, the ejection device 230 may include a gas supply manifold 232 having a gas discharge port 234 defining an ejection position 270 of the ejection device 230 that is fixed in relation to the ejection wheel 200 (e.g., at a 12 o-clock position at the bottom of the ejection wheel 200) and does not move in relation to the ejection system 20, the container filling system 10, and/or the packaging machine 1 while the ejection wheel 200 rotates. The gas supply manifold 232 may be coupled to a pressurized gas supply (not shown). The ejection device 230 may be configured to direct a gas (e.g., pressurized air) received from the pressurized gas supply (not shown) and through the gas supply manifold 232 to the gas discharge port 234. The gas discharge port 234 may face towards (e.g., radially away from the second central rotation axis 202) and may be exposed to an inner surface 2161 of one or more ejection plates 210 that are located at the ejection position 270 (e.g., via a conduit 228 through the inner wheel 220 as shown in FIG. 2B), so that the gas discharge port 234 may be in fluid communication with the cups 212 of the one or more ejection plates 210 at the ejection position 270 via the conduits 214 extending through the one or more ejection plates 210. It will be understood that the ejection position 270 may be defined as a three-dimensional space having horizontal boundaries defined by the ejection device 230 and a vertical thickness defined by at least a thickness of an ejection plate 210 that may be within such horizontal boundaries. An ejection plate 210 that is "at" the ejection position 270 may be referred to interchangeably as being partially or entirely "in" or "within" the ejection position 270.

As shown, the ejection device 230 may include one or more structures that may isolate the cups 212 and conduits 214 of one or more ejection plates 210 at the ejection position 270 from the inner enclosure 223 of the ejection system 20 and may thus isolate the cup(s) 212 of the one or more ejection plates 210 from the vacuum induced in the inner enclosure 223 by the vacuum system 280, based on the one or more ejection plates 210 being at the ejection position 270. The ejection device 230 may further expose the gas discharge port(s) 234 to the conduits 214, and thus the cups 212, of an ejection plate 210 that is at the ejection position 270. Based on the isolation of an ejection plate 210 at the ejection position 270 from the inner enclosure 223, alone or in combination with directing a gas 236 through the exposed conduits 214 of the one or more ejection plates 210 at the ejection position 270 into the cup(s) 212 of such ejection plates 210, the ejection device 230 may cause material articles 90 held in the cup(s) 212 of the one or more ejection plates 210 to be ejected 92 from the cups 212, and thus from the ejection system 20 at the ejection position 270. The ejection device 230 may supply the pressurized gas 236 through the gas discharge port(s) 234 continuously and may isolate the gas discharge port(s) 234 from ejection plates 210 that are external to the ejection position 270. As a result, a given ejection plate 210 of the ejection wheel may be selectively isolated from the vacuum in the inner enclosure 223 and exposed to a gas discharge port 234 based on the given ejection plate 210 being at the ejection position 270. The given ejection plate 210 may be further isolated from the gas discharge port 234 and exposed to the vacuum in the inner enclosure 223 based on the given ejection plate 210 being external to the ejection position 270.

As the ejection wheel 200 rotates 294, the ejection device 230 may cause the material articles held in the cups 212 of each ejection plate 210 to be ejected 92 based on the ejection plate 210 moving through the ejection position 270. Because the rotation 294 of the ejection wheel 200 at a certain, fixed rate of rotation (herein also referred to as a second rate of rotation) causes the ejection plates 210 to move through the ejection position 270 at a certain rate (e.g. a certain fixed speed), and a plurality 602 of material articles 90 are caused to be ejected 92 from each ejection plate 210 based on the ejection plate 210 moving through the ejection position 270, the ejection system 20 may cause separate, respective pluralities 602 of material articles 90 corresponding to the cups 212 of separate, respective ejection plates 210 to be ejected 92 (also referred to herein as being indexed) from the ejection system 20 at a certain interval (or rate) that corresponds to (e.g., is based on) the rate of rotation 294 of the ejection wheel 200.

Each separate plurality 602 of material articles 90 ejected from a plurality of cups 212 of a given ejection plate 210 may be ejected simultaneously or substantially simultaneously based on the given ejection plate 210 moving through the ejection position 270. For example, as shown, an ejection plate 210 may include a plurality of cups 212 that are aligned with an axis that is paraxial to (e.g., extends in parallel with) the second central rotation axis 202 such that the cups 212 may enter and exit the ejection position 270 in parallel simultaneously or substantially simultaneously. Furthermore, based on such alignment of the cups 212 in each ejection plate 210, the plurality 602 of material articles 90 ejected from the cups 212 of each given ejection plate 210 may be ejected as a linear pattern of material articles 90 aligned in a direction extending paraxial to (e.g., parallel to) the second central rotation axis 202 (e.g., as shown in FIGS. 3 and 5). As a result, the ejection system 20 may be configured to eject separate, respective linearly-arranged pluralities 602 of material articles 90 at a fixed time interval.

While ejection system 20 is shown in FIGS. 1-6C to include an ejection wheel 200, it will be understood that example embodiments are not limited thereto. In some example embodiments, the ejection system 20 may include any machine, apparatus or the like that is configured to eject 92 (e.g., index) separate sets of one or more material articles 90 (e.g., separate pluralities 602 of material articles 90) at a fixed time interval. The ejection system 20 may include any machine, apparatus or the like that is configured to eject 92 (e.g., index) separate pluralities 602, that are each a linear pattern of material articles 90 aligned with the fixed radial direction 172 of the rotatable apparatus 100, at a fixed time interval. While the ejection wheel 200 is shown to include ejection plates 210 that each include a plurality of cups 212 and thus is configured to hold (and eject 92) a plurality of material articles 90, such that the ejection system 20 is configured to eject 92 separate pluralities 602 of material articles 90 at a fixed time interval, it will be understood that the ejection plates 210 may each include any quantity of cups 212, including a single cup 212 per ejection plate 210, such that an ejection system 20 may be configured to eject any quantity of material articles 90 at the fixed time interval. Accordingly, while example embodiments are described herein to refer to a "plurality" 602 of material articles being ejected from the ejection system 20 at a fixed time interval, it will be understood that such described ejections 92 may apply equally to ejecting 92 an individual material article 90 at the fixed time interval (e.g., indexing individual material articles 90 at a fixed time interval).

It will be understood that the ejection device 230 is not limited to using a combination of vacuum isolation and pressurized gas 236 to eject material articles from ejection plates 210 at the ejection position 270. For example, in some example embodiments, the ejection device 230 may omit the gas supply manifold 232 and gas discharge port 234 and may cause material articles to be ejected from the ejection system 20 based on isolating the cups 212 of an ejection plate 210 at the ejection position 270 from the vacuum induced by the vacuum system 280 so that the material articles simply fall from the cups 212 at the ejection position 270 under gravity. In some example embodiments, the ejection system 20 may omit the ejection wheel 200 and the ejection device 230 may include one or more various mechanisms configured to eject one or more material articles 90, including for example a reciprocating piston ejection system, a conveyor system, or the like.

Still referring to FIGS. 1A-1C, and further referring to FIGS. 3-5B, the container filling system 10 may include a rotatable apparatus 100 that may be configured to cause a lane 80 of one or more containers 82 to be moved continuously along an arcuate path 84 at a fixed speed while causing each separate container 82 to receive (e.g., to be filled with) a particular quantity of material articles 90 (e.g., directing a particular quantity of material articles 90 into each of the separate containers 82).

As shown, the rotatable apparatus 100 may include a rotatable drum 110 (also referred to herein as a rotary drum) having a first central rotation axis 112 (also referred to herein as a central rotation axis, a central longitudinal axis, a first central axis of rotation, or the like) and including a circumferential pattern 113 of a circumferential plurality of funnels 116 having rotational symmetry around the first central rotation axis 112. As described herein, the circumferential plurality of funnels 116 may be referred to herein interchangeably as a plurality of funnels 116, a circumferential pattern 113 of a plurality of ejection plates 210. The container filling system 10 may include a drive motor 490, which may be any known motor, including an electrical motor, a servo motor, or the like. The rotatable drum 110 may be mechanically coupled to the drive motor 490. For example the rotatable apparatus 100 may include a shaft 106 fixed to the rotatable drum 110 and a pulley 108 fixed to the shaft 106, and the rotatable apparatus 100 may be configured to be mechanically coupled, and thus to be driven by, the drive motor via a drive belt 492 (e.g., serpentine belt) extending around the pulley 108. The rotatable drum 110 may thus be configured to rotate around the first central rotation axis 112 (e.g., at a fixed, first rate of rotation), for example based on operation of the drive motor 490. In some example embodiments, the rotatable apparatus 100 may be mechanically coupled to and/or configured to be driven by a drive motor that is external to the container filling system 10. In some example embodiments the rotatable apparatus 100 may omit one or both of pulley 108 and/or shaft 106. For example in some example embodiments the rotatable apparatus 100 may be directly connected (e.g., at shaft 106) to a drive shaft of a drive motor 490, such that the pulley 108 and the drive belt 492 may be omitted from the container filling system 10.

As shown, each funnel 116 of the circumferential plurality of funnels 116 may be oriented paraxial to (e.g., extending in parallel with) the first central rotation axis 112 and may define a top opening 116U at a top end 110U of the rotary drum and a bottom opening 116B at a bottom end 110B of the rotatable drum 110, where the funnels 116 may each taper in cross-sectional area from the respective top opening 116U toward the respective bottom opening 116B in the direction paraxial to (e.g., extending in parallel with) the first central rotation axis 112.

The rotatable apparatus 100 may include a rotatable turret 120. The rotatable turret 120 may be configured to engage multiple containers 82 to cause the containers 82 to be axially aligned with the bottom openings 116B of separate, respective funnels 116 while moving along an arcuate path 84. The rotatable turret 120 may be rotationally fixed to the rotatable drum 110. For example, the rotatable turret 120 may be fixed to the same shaft 106 that is fixed to the rotatable drum, but example embodiments are not limited thereto. As shown, the rotatable turret 120 may include a circumferential plurality of arms 124 having rotational symmetry around the first central rotation axis 112 and at least partially defining a plurality of recesses 126 that have rotational symmetry around the first central rotation axis 112 and axially overlap (e.g., in a vertical direction that is paraxial to, or extends in parallel with, the first central rotation axis 112) separate, respective bottom openings 116B of the plurality of funnels 116 of the rotatable drum 110. As shown in at least FIGS. 4-5B, the rotatable turret 120 may be configured to hold separate, respective containers 82 of the lane 80 in separate, respective recesses 126 and thus hold the separate containers 82 to be axially aligned with the bottom openings 116B of separate, respective funnels 116. It will be understood that the rotatable turret 120 is not limited to the structure of arms 124 described herein. Furthermore, in some example embodiments the rotatable turret 120 may be omitted and the rotatable apparatus 100 may rotate around the first central rotation axis 112 independently of a lane 80 of containers 82 moving along an arcuate path 84 (e.g., defined by a base structure 150, one or more additional turrets 410 and/or conveyor systems, etc.) while at least some of the containers 82 moving along the arcuate path 84 are axially aligned with one or more separate, respective bottom openings 116B of one or more funnels 116 of the rotatable apparatus 100.

Referring to FIGS. 4-5B, the container filling system 10 may include a base structure 150, where at least the rotatable drum 110 may be rotatably coupled (e.g., via a bearing) thereto. The base structure 150 may include surfaces and/or structures that at least partially define one or more spaces, recesses or the like in which one or more devices (e.g., turrets) may be located to at least partially define one or more paths (e.g., tracks) along which the lane 80 of containers 82 may be directed to continuously move. The base structure 150 may include an arcuate rim 154 and one or more surfaces defining a space 154A to at least partially accommodate the rotatable apparatus 100, where an inner surface of the space 154A as at least partially defined by the arcuate rim 154 may at least partially define an outer edge of the arcuate path 84. The rotatable turret 120 may be configured to engage containers 82 with azimuthally adjacent arms 124 and cooperate with the arcuate rim 154 to hold the containers 82 in separate, respective recesses 126 and to move the engaged containers 82 along the arcuate path 84 (also referred to herein as an arcuate track) around the first central rotation axis 112 at the rate of rotation of the rotatable apparatus 100 (e.g., at a fixed speed) while remaining axially aligned with the containers 82 are held axially aligned with separate, respective bottom openings 116B of separate, respective funnels 116.

The base structure 150 may also include one or more structures that may at least partially define an inlet 1601 and an outlet 1600 of the rotatable apparatus 100. For example, the base structure 150 may include an intake chute 152 between the inlet 1601 of the rotatable apparatus 100 and a lane inlet 510 that is configured to receive the lane 80 of containers 82 into the container filling system 10. The container filling system 10 may be configured to direct the lane 80 of containers 82, entering the container filling system 10 via the lane inlet 510, to move through the intake chute 152 to sequentially enter the space 154A via the inlet 1601 to be engaged by one or more arms 124 of the rotatable turret 120 and axially aligned with separate, respective funnel 116 bottom openings 116B while being caused (e.g., based on engagement between one or more arms 124 and a container 82) to move along the arcuate path 84.

In some example embodiments, the container filling system 10 may include one or more devices external to the rotatable apparatus 100 which may be configured to at least partially enable continuous movement of the lane 80 upstream and/or downstream of the rotatable apparatus 100. For example, in the example embodiments shown in FIGS. 1A-1C and 3-5B, the container filling system 10 further includes a plurality of turrets 410 rotatably coupled to the base structure 150 and positioned within respective recess regions 158 (also referred to herein as recesses, recess spaces, or the like) defined by surfaces of the base structure 150 between an outlet 1600 of the rotatable apparatus 100 and a lane outlet 520 of the container filling system 10, such that the turrets 410 are downstream of the rotatable apparatus 100. The turrets 410 may be coupled to a drive motor, for example the same drive motor 490 coupled to the rotatable apparatus 100 via the same drive belt 492 and via one or more pulleys 430, 420, or the like, so that the rotatable drum 110, rotatable turret 120 and additional turrets 410 may rotate or counter rotate in synchronization with each other. In some example embodiments, the container filling system 10 may include one or more turrets 410 located between the inlet 1601 and the lane inlet 510 and configured to move containers 82 of the lane 80 toward the inlet 1601 of the rotatable apparatus 100. It will be understood that, in some example embodiments, the container filling system 10 may omit the turrets 410.

As shown, the base structure 150 may include and/or define a ramp 156 at the outlet 1600 that is configured to direct containers 82 held by opposing arms 124 of the rotatable turret 120 to move along the arcuate path 84 in the space 154A to drop axially (e.g., in a direction paraxial or parallel to first central rotation axis 112) out of the respective recesses 126 in which the containers 82 are held and further drop axially out of the space 154A as the containers 82 move along the arcuate path 84 to the outlet 1600 of the rotatable apparatus 100. The turrets 410 may be positioned to rotate 412 (e.g., rotate and/or counter-rotate in synchronization) to engage containers 82 passing through the outlet 1600 and/or dropping axially along the ramp 156 and to move continuously (e.g., at a fixed speed) along a discharge path 88 defining at least a portion of the lane 80 between the outlet 1600 of the rotatable apparatus 100 and a lane outlet 520 of the container filling system 10.

As further shown in FIGS. 1A and 5A, the packaging machine 1 may include a packing device 40 (e.g., a motorized, reciprocating piston) that moves vertically in a reciprocating motion to pack material articles held in the containers 82 moving along the discharge path 88 toward the lane outlet 520. However, example embodiments are not limited thereto. It will be understood that, while FIGS. 1A-1C and 3-5B illustrate one or more containers 82 in the lane 80, the lane 80 may include a greater or smaller quantity of containers 82 than are illustrated. For example, the lane 80 may include a sufficient quantity of containers 82 so that the rotatable turret 120 holds a separate container 82 in each recess 126 between inlet 1601 and outlet 1600 along the arcuate path 84. In some example embodiments, the container filling system 10, the packaging machine 1, or the like may not include any of the containers 82 shown, such that the containers 82 shown in FIGS. 1A-5B are omitted. The container filling system 10 may be configured to receive one or more containers 82 via the lane inlet 510.

As shown in at least FIGS. 1A, 1C, 3, and 5, the ejection system 20 may be fixed in position in relation to the rotatable apparatus 100 of the container filling system 10, such that at least a portion of the ejection wheel 200 (e.g., the bottom portion of the ejection wheel 200 including the ejection position 270 at the 12 o-clock position thereof) may vertically overlap a portion of the rotatable drum 110 in a vertical direction 174 that is paraxial with (e.g., extends in parallel with) the first central rotation axis 112. As shown, the ejection device 230, fixed in position in relation to the ejection wheel 200, may define the ejection position 270 at the 12 o-clock position of the ejection wheel 200 which may further vertically overlap and at least partially define a material receiving position 170 of the rotatable drum 110 in the vertical direction 174 extending paraxial to (e.g., parallel to) the first central rotation axis 112. The material receiving position 170 (also referred to herein as a material receiving region, a material receiving area, a "fixed" material receiving position, a "fixed" material receiving area, a "fixed" material receiving region, etc.) may be defined in the vertical direction 174 by the portion of the rotatable apparatus 100 vertically overlapping the ejection position 270 in the vertical direction 174. As shown, the material receiving position 170 may be defined in the vertical direction 174 by the respective top and bottom ends 110U and 110B of a portion of the rotatable drum 110 (e.g., a portion of the plurality of funnels 116 extending from the top openings 116U to the bottom openings 116B thereof) vertically overlapping the ejection position 270 in the vertical direction 174. The material receiving position 170 may be defined in the horizontal direction by the horizontal boundaries of the ejection position 270 (e.g., the horizontal boundaries of an ejection plate 210 that is exposed to the ejection device 230 as shown in at least FIGS. 4 and 5), such that the material receiving position 170 may be understood to represent a portion of the plurality of funnels 116 that is positioned to vertically overlap the ejection position 270 and thus is positioned to receive one or more material articles 90 that are ejected 92 from the ejection system 20 (e.g., from the ejection position 270). It will be understood that an element that is "at" the material receiving position 170 may be referred to as being at least partially "in" or "within" the material receiving position 170.

As described herein, the ejection system 20 may be configured to eject a plurality 602 of material articles 90 based on rotation of the ejection wheel 200 to move an ejection plate 210 through the ejection position 270, and such a plurality 602 of material articles 90 may be ejected downwards, along the vertical direction 174, into one or more funnels 116 of the rotatable drum 110 which are at and/or moving through the material receiving position 170, through respective top openings 116U of the one or more funnel 116. Each funnel 116 may be tapered downwards along the vertical direction 174 from the top opening 116U thereof to the bottom opening 116B thereof and may direct material articles 90 received from the ejection system 20 through the respective top opening 116U of the funnel 116 to pass through the bottom opening 116B into a container 82 held in axial alignment with the bottom opening 116B by the rotatable turret 120. As the rotatable apparatus 100 rotates 122 around the first central rotation axis 112, different funnels 116 may move continuously into and out of the material receiving position 170 concurrently with the ejection system 20 ejecting one or more pluralities 602 of material articles 90. Each funnel 116 may receive one or more material articles 90 from the ejection system 20 via the respective top opening 116U of the funnel 116 based on the funnel 116 moving through the material receiving position 170 while the ejection system 20 ejects one or more material articles 90, and the funnel 116 may direct any received material articles 90 through the bottom opening 116B thereof to direct the material articles 90 down to an axially-aligned recess 126 of the rotatable turret 120 and any container 82 located therein.

In some example embodiments, the rotatable apparatus 100 may be configured to direct each material article 90 received into each separate funnel 116 of the plurality of funnels into a separate air vent conduit 130 such that air displaced by the material article 90 moving through the air vent conduit is vented externally to the air vent conduit through one or more openings 130A extending through a thickness 130T of a cylindrical sidewall of the separate air vent conduit 130. As shown, the rotatable apparatus 100 may include a plurality of air vent conduits extending from separate, respective bottom openings to separate, respective recesses 126 of the rotatable turret 120. Each air vent conduit 130 may include one or more openings 130A extending through a thickness 130T of a cylindrical sidewall of the air vent conduit 130. The air vent conduits 130 may direct material articles 90 passing from the funnels 116 to separate, respective containers 82 held in axial alignment with the respective air vent conduits 130 by the rotatable turret 120. The air vent conduits 130 may be configured to direct air displaced by the material articles 90 moving from the funnel 116 to the container 82 to be pushed out of the air vent conduits 130 by the material articles 90 via the one or more openings 130A, thereby improving flow of material articles 90 to the containers 82.

Still referring to at least FIGS. 1A, 1C, 3, and 5, the rotatable drum 110 may be configured to position a portion of the plurality of funnels 116 in the material receiving position 170 and may be configured to rotate around the first central rotation axis 112 so that the rotatable drum 110 moves the funnels 116 through the material receiving position 170 based on the circumferential plurality of funnels 116 rotating around the first central rotation axis 112. The rotatable apparatus 100, and thus the rotatable drum 110, may rotate around the first central rotation axis 112 at a fixed, first rate of rotation while (concurrently with) the ejection system 20 ejects separate pluralities 602 of material articles 90 from the ejection position 270 at a fixed time interval (e.g., based on rotation of the ejection wheel 200 around the second central rotation axis 202 at a fixed, second rate of rotation). As a result, the rotatable apparatus 100 may be configured to direct various material articles 90 ejected from the ejection system 20 into various funnels 116, and thus into one or more various containers 82 axially aligned therewith, based on rotating at a fixed rate so that one or more funnels 116 move continuously through the material receiving position 170.

Figure 6A:
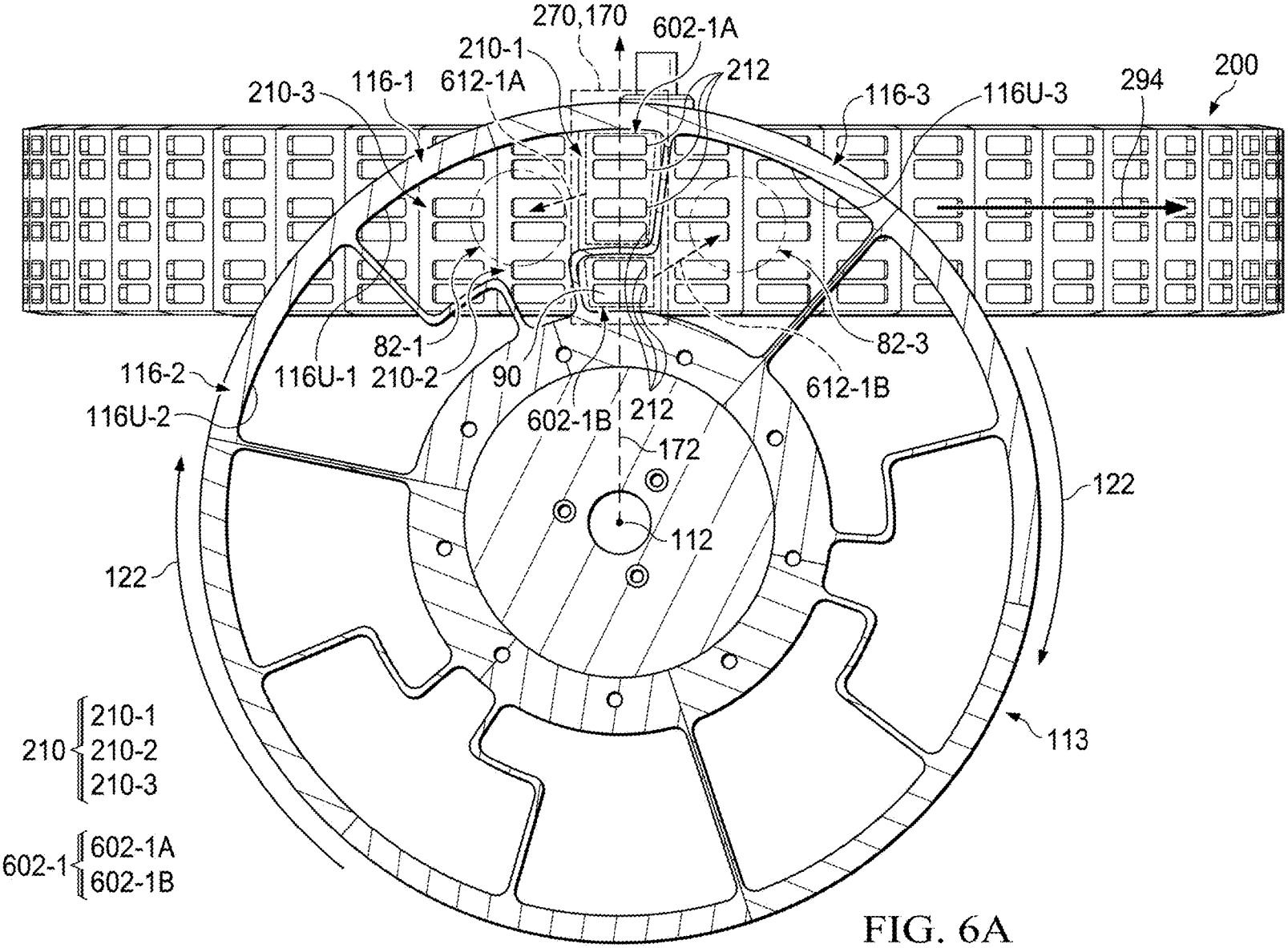
FIGS. 6A, 6B, and 6C are bottom cross-sectional views along cross-sectional view line VI-VI' of FIG. 1C, during rotation of a rotatable apparatus and an ejection wheel of an ejection system, according to some example embodiments.
Figure 6B:
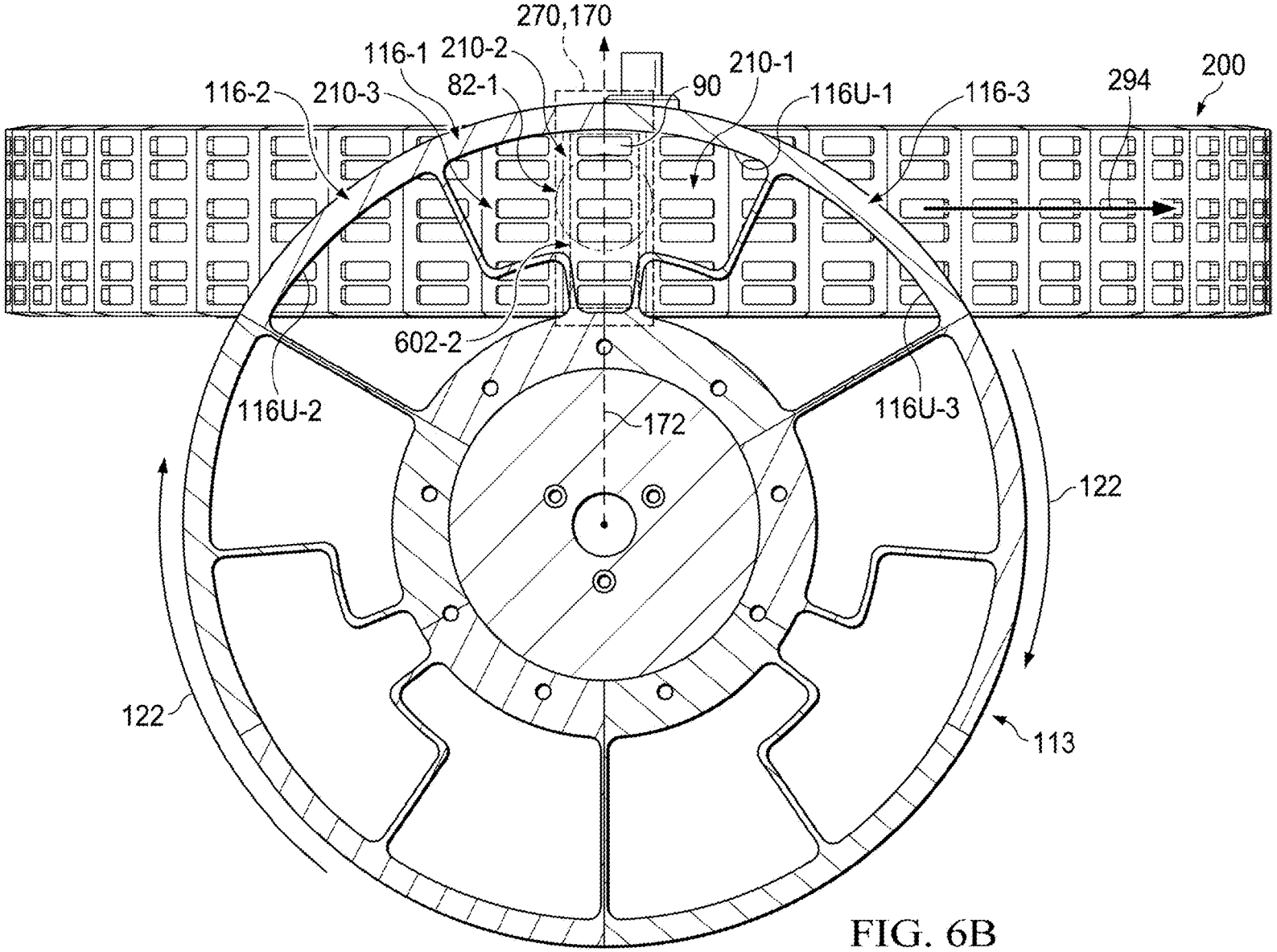
Figure 6C:
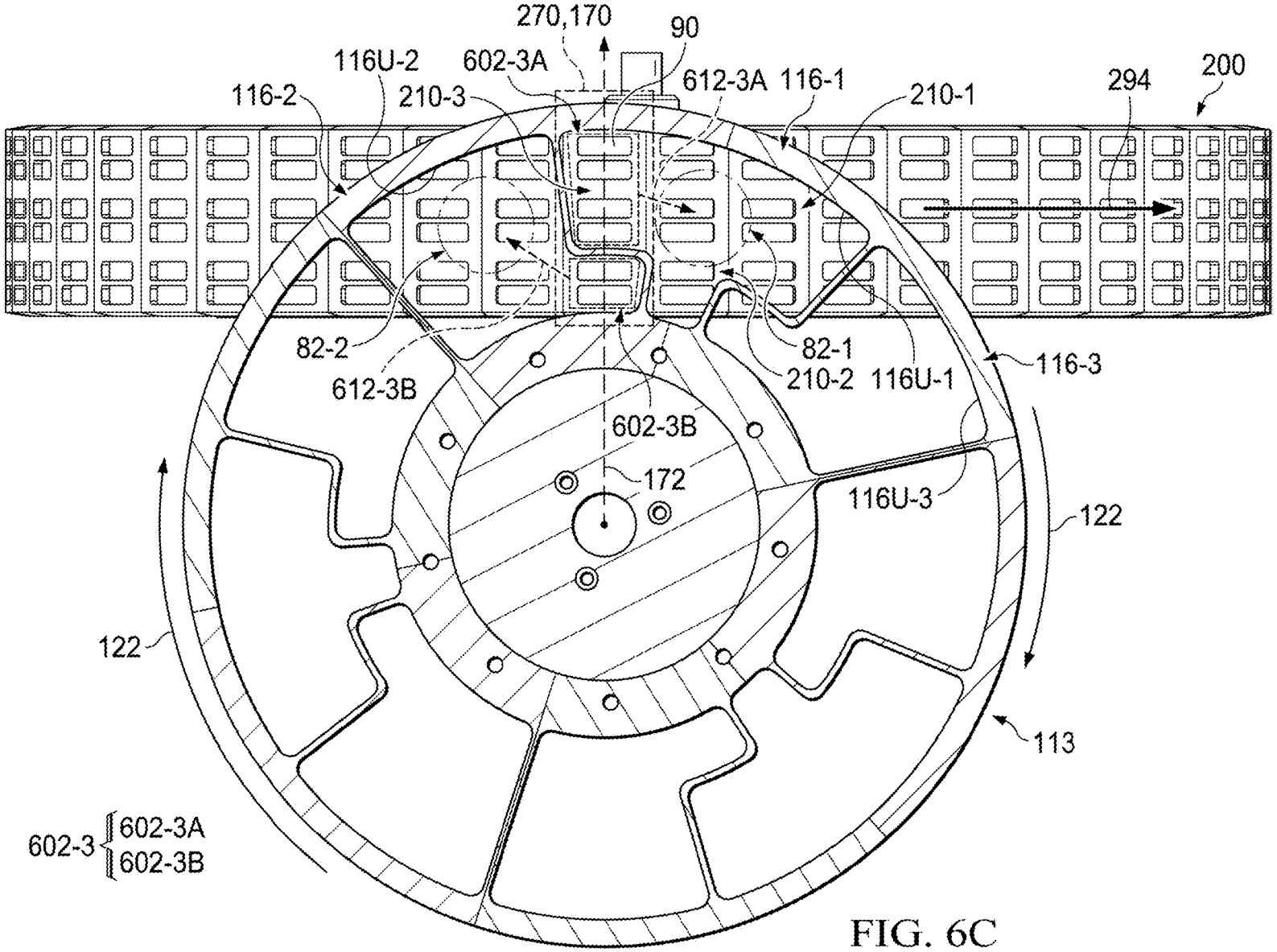

Still referring to at least FIGS. 1A, 1C, 3, and 5 and now referring further to FIGS. 6A-6C, the rotatable apparatus 100 may be configured to direct different portions a given plurality 602 of material articles 90 ejected from the ejection system 20 into separate funnels 116 and thus into separate containers 82 based on rotation of the rotatable drum 110 and the plurality of funnels 116 therein through the material receiving position 170.

In some example embodiments, and as shown in at least FIGS. 3, 5, and 6A-6C, the ejection system 20 is configured to eject each separate plurality 602 of material articles 90 at the fixed time interval so that each plurality 602 of material articles 90 is ejected as a linear pattern of material articles 90 that are aligned with (e.g., at least partially overlap in the vertical direction as shown in at least FIGS. 5A-5B) a fixed radial direction 172 extending radially from the first central rotation axis 112 and intersecting the material receiving position 170. It will be understood that the fixed radial direction 172 and the material receiving position 170 (also referred to herein interchangeably as a fixed material receiving position 170) may each be fixed in relation to the container filling system 10, the ejection system 20 (e.g., in relation to the ejection device 230), or the like such that the material receiving position 170 and the fixed radial direction 172 do not move with the rotatable apparatus 100 as the rotatable apparatus 100 rotates 122. Instead, the rotatable apparatus 100 may rotate 122 so that each funnel 116 may move through the fixed material receiving position 170 and may cross the fixed radial direction 172 once per rotation of the rotatable apparatus 100 around the first central rotation axis 112. In example embodiments where the ejection system 20 includes the ejection wheel 200, and as shown in at least FIGS. 3 and 5, the fixed radial direction 172 may extend in parallel with the second central rotation axis 202 of the ejection wheel 200.

As noted above, the ejection plates 210 may include a plurality of cups 212 configured to hold separate, respective material articles, where the cups 212 may be aligned in a direction paraxial with (e.g., parallel with) the second central rotation axis 202 of the ejection wheel 200, and the ejection system 20 may be configured to cause each ejection plate 210 to simultaneously or substantially simultaneously eject the plurality 602 of material articles 90 held in the separate, respective cups 212 of a given ejection plate 210 based on the given ejection plate 210 moving through the ejection position 270. As shown in FIGS. 5 and 6A-6C, the ejection wheel 200 may be oriented in relation to the rotatable drum 110 so that the ejection position 270, and thus the cups 212 of an ejection plate 210 moving through the ejection position 270, may be aligned with the fixed radial direction 172 extending radially from the first central rotation axis 112 of the rotatable drum 110, such that the ejection system 20 may eject 92 each separate plurality 602 of material articles, from each separate ejection plate 210, as the linear pattern of material articles 90 that are aligned with the radial direction 172.

In some example embodiments, and as shown in at least FIGS. 3, 5, and 6A-6C, at least some funnels 116 of the plurality of funnels 116 of the rotatable drum 110 may have respective top openings 116U that have different shapes (also referred to herein as the respective top openings 116U of the funnels 116 having different intrinsic shapes) so that the rotatable drum 110 causes different portions of one or more ejected pluralities 602 of material articles 90 to be directed into different funnels 116 moving through the material receiving position 170 (and thus into different containers 82 held in axial alignment with the respective bottom openings 116B of the different funnels 116). For example, as shown in at least FIGS. 6A-6C, the rotatable drum 110 may be configured to rotate to cause different portions of a given ejected plurality 602 of material articles 90 ejected from the ejection system to be directed into different, azimuthally adjacent funnels 116 of the rotatable drum 110 that are least partially simultaneously at (e.g., "within") the material receiving position 170, for example based on separate portions of the azimuthally adjacent funnels 116 being radially aligned in the radial direction 172.

It will be understood that "azimuthally adjacent" funnels 116 as described herein (e.g., the first and second funnels 116-1 and 116-2, the first and third funnels 116-1 and 116-3, etc.) may be partially azimuthally adjacent to each other, such that respective portions of the azimuthally adjacent funnels 116 are azimuthally adjacent to each other and do not overlap in a radial direction 114 extending radially from the first central rotation axis 112, and at least a portion of each of the azimuthally adjacent funnels 116 overlap in the radial direction 114 and thus are at least partially azimuthally aligned. It will be understood that "azimuthally adjacent" top openings 116U of azimuthally adjacent funnels 116 as described herein (e.g., the first and second top openings 116U-1 and 116U-2, the first and third top openings 116U-1 and 116U-3, etc.) may be partially azimuthally adjacent to each other, such that respective portions of the azimuthally adjacent top openings 116U are azimuthally adjacent to each other and do not overlap in a radial direction 114 extending radially from the first central rotation axis 112, and at least a portion of each of the azimuthally adjacent top openings 116U overlap in the radial direction 114 and thus are at least partially azimuthally aligned.

For example, as shown in at least FIGS. 3, 5, and 6A-6C, the plurality of funnels 116 may include at least two funnels 116, including at least two azimuthally adjacent funnels 116-1 and 116-2 or the like having different shapes, for example such that the two azimuthally adjacent funnels 116-1, 116-2 of the circumferential plurality of funnels 116 define respective, azimuthally adjacent top openings 116U-1 and 116U-2 having different intrinsic shapes. As shown in at least FIGS. 5A-5B, a first funnel 116-1 of the plurality of funnels 116 may have an azimuthally symmetric shape that is symmetrical around a radial axis of symmetry 128, such that the top opening 116U-1 of the first funnel 116-1 may be azimuthally symmetric around the radial axis of symmetry 128. In another example, at least one funnel, such as the second funnel 116-2 and/or the third funnel 116-3 which are azimuthally adjacent to the first funnel 116-1 having a different shape, may be azimuthally asymmetric and thus may have a respective top opening 116U-2 and/or 116U-3 that is azimuthally asymmetric and is different in shape from the top opening 116U-3 of the azimuthally adjacent first funnel 116-1. As shown in at least FIGS. 5A-5B and 6A-6C, at least a portion of the respective top openings 116U-1 and 116U-2 of the azimuthally adjacent funnels 116-1 and 116-2 at least partially overlap in the radial direction 114 extending radially from the first central rotation axis 112 of the rotatable apparatus 100, and at least a portion of the respective top openings 116U-1 and 116U-3 of the azimuthally adjacent funnels 116-1 and 116-3 at least partially overlap in the radial direction 114.

Still referring to at least FIGS. 5A-5B, each top opening 116U of the funnels 116, including for example each top opening of azimuthally adjacent and differently-shaped funnels 116, may define at least one first azimuthal area 166-1 and at least one second azimuthal area 166-2 that is azimuthally adjacent to the at least one first azimuthal area 116-1. The first and second azimuthal areas 166-1 and 166-2 of a given top opening 116U may define a same central angle in relation to the first central rotation axis 112 or different central angles. Each first azimuthal area 166-1 of the plurality of funnels 116 may have a same or substantially same first radial width 168-1. Each first radial width 168-1 may be a radial width between a radially outermost inner surface 116SO and a radially innermost inner surface 116SI of the at least one funnel 116 at the top opening 116U of the at least one funnel 116 and thus equal to a maximum radial width 138 of the plurality of funnels 116. Each second azimuthal area 166-2 of a top opening 116U of a given funnel 116 may have a radial width 168-2 that is smaller than the first radial width 168-1. Second azimuthal areas 166-2 of different funnel 116 may have different areas and/or different-magnitude second radial widths 168-2. Each of the first and second azimuthal areas 166-1 and 166-2 of the plurality of funnels 116 may define a same central angle 112A from the first central rotation axis 112. As shown in FIGS. 5A-5B, the central angle 112A may be (360)/(21)=about 17.143 degrees.

For example, as shown in FIGS. 5A-5B, the top opening 116U-1 of the first funnel 116-1 may define a first azimuthal area 166-1 and azimuthally adjacent second azimuthal areas 166-2 at opposite sides of the first azimuthal area 166-1, where the respective first and second azimuthal areas 166-1 and 166-2 of the top opening 116U-1 of the first funnel 116-1 define a same central angle 112A with the first central rotation axis 112. In another example, as shown in FIGS. 5A-5B, the top opening 116U-2 of the second funnel 116-2 may define two azimuthally adjacent first azimuthal areas 166-1 and a single azimuthally adjacent second azimuthal area 166-2, where the first and second azimuthal areas 116-1 and 166-2 of the second funnel 116-2 define a same central angle 112A. The first azimuthal areas 166-1 of the top openings 116U of each of the funnels 116 may have a same or substantially same cross-sectional area in the plane orthogonal to the first central rotation axis 112. In another example, as shown in FIG. 5B, the top opening 116U-3 of the third funnel 116-3 may define two azimuthally adjacent first azimuthal areas 166-1 and a single azimuthally adjacent second azimuthal area 166-2, where the first and second azimuthal areas 166-1 and 166-2 of the third funnel 116-3 define a same central angle 112A. In some example embodiments, including the example embodiments shown in FIGS. 5A and 5B, each of the top openings 116U of each of the funnels 116 of the rotatable drum 110, including each of the top openings 116U-1, 116U-2, and 116U-3 of the first, second, and third funnels 116-1, 116-2, and 116-3, may include at least one first azimuthal area 166-1 and at least one second azimuthal area 166-2, where each first azimuthal area 166-1 and each second azimuthal area 166-2 of each funnel 116 of the rotatable drum 110 defines a same central angle 112A, such that all of the first and second azimuthal areas 166-1 and 166-2 of the plurality of funnels 116 define a same central angle 112A. The first azimuthal areas 166-1 of the top openings 116U of each of the funnels 116 may have a same or substantially same cross-sectional area in the plane orthogonal to the first central rotation axis 112. The combined first and second azimuthal areas 166-1 and 166-2 of each of the separate top openings 116U of each of the funnels 116 may have a same or substantially same cumulative cross-sectional area magnitude. The cross-sectional areas of each of the separate top openings 116U of each of the funnels 116 may have a same or substantially same cross-sectional area magnitude.

As shown, at least one second azimuthal area 168-2 of azimuthally adjacent top openings of azimuthally adjacent funnels 116 (e.g., top openings 116U-1 and 116U-2) may have different shapes and may at least partially overlap in the radial direction 114. The sum of the respective second radial widths 168-2 of the radially overlapping second azimuthal areas 168-2 of the two azimuthally adjacent top openings 116U-1 and 116U-2 may be equal to or less than the first radial width 168-1 of the first azimuthal areas 166-1 of the azimuthally adjacent funnels (e.g., funnels 116-1 and 116-2 as shown in FIGS. 5A-5B).

For example, the first azimuthal area 166-1 of at least one funnel 116 of the plurality of funnels 116 may have a first radial width 168-1 that is a radial width between a radially outermost inner surface 116SO and a radially innermost inner surface 116SI of the at least one funnel 116 at the top opening 116U of the at least one funnel 116. The second azimuthal area 166-2 of the at least one funnel 116 may have a second radial width 168-2 that extends radially from one of the radially outermost inner surface 116SO or the radially innermost inner surface 116SI of the at least one funnel 116 at the top opening 116U of the at least one funnel 116. In some example embodiments, the respective cross-sectional areas (in a plane orthogonal to the first central rotation axis 112) of each of the top openings 116U of the plurality of funnels 116 may be a same magnitude, despite at least some of the top openings 116U of the plurality of funnels 116 having different shapes.

As shown with regard to at least funnels 116-1 and 116-2 in FIGS. 5A-5B, and at least funnels 116-1 and 116-3 in FIG. 6A, two azimuthally adjacent funnels (e.g., respective proximate second azimuthal areas 168-2 of adjacent funnels 116-1 and 116-2, 116-1 and 116-3, etc.) may at least partially at least partially overlap in a radial direction 114 extending radially from the first central rotation axis 112. As a result, the at least partially radially overlapping portions of the azimuthally adjacent funnels 116 may simultaneously or substantially simultaneously move through the material receiving position 170 as the rotatable drum 110 rotates 122 around the first central rotation axis 112, so that different portions of a given plurality 602 of material articles 90 received simultaneously into the material receiving position 170 may be directed into the different azimuthally adjacent funnels 116 (and thus into different containers 82).

Still referring to FIGS. 5A-5B and 6A-6C, the circumferential plurality of funnels 116 may include one or more sets 118 of azimuthally adjacent funnels. The entire plurality of funnels 116 of the rotatable drum 110 may include a fixed multiple of sets 118 of funnels. For example, in the example embodiments shown in FIGS. 1 and 3-6C, the rotatable drum 110 includes three separate sets 118 of funnels 116, but example embodiments are not limited thereto. The set 118 of funnels may be collectively azimuthally symmetric (e.g., around an axis of symmetry 128) but individual funnels 116 within the set 118 may not be azimuthally symmetric. For example, as shown in FIGS. 5A-5B, a given set 118 of funnels may include a first funnel 116-1 having a first funnel top opening 116U-1, a second funnel 116-2 having a second funnel top opening 116U-2, and a third funnel 116-3 having a third funnel top opening 116U-3. As shown, the first funnel 116-1 may be azimuthally between the second funnel 116-2 and the third funnel 116-3. The first funnel top opening 116U-1 may be azimuthally symmetric (e.g., around axis of symmetry 128), and the second funnel top opening 116U-2 and the third funnel top opening 116U-3 may each be azimuthally asymmetric and may each have reflective azimuthal symmetry around the axis of symmetry 128 that extends radially from the first central rotation axis 112. While the set 118 is shown to include three funnels 116-1, 116-2, and 116-3, it will be understood that a given set 118 of funnels 116 in a rotatable drum 110 may include any quantity of funnels having any shapes. In some example embodiments, the funnels 116 of a given set 118 of funnels in a rotatable drum 110 may have a same shape. In some example embodiments, a given set 118 of funnels in a rotatable drum 110 may include multiple funnels 116 collectively having one or more azimuthally symmetric shapes, one or more azimuthally asymmetric shapes, or any combination thereof.

Still referring to at least FIGS. 5A-5B and 6A-6C, the ejection system 20 may be configured to eject each separate plurality 602 of material articles 90 as multiple separate groups 222 of one or more material articles 90 that are spaced apart along the fixed radial direction 172, such that adjacent groups 222 of material articles 90 of the ejected plurality 602 are spaced apart along the radial direction 172 by a spacing distance 224. For example, as shown in at least FIG. 5A, each ejection plate 210 may include a plurality of cups 212 located within a spacing distance 226 and arranged in multiple separate groups 222 that are spaced apart by a fixed spacing distance 224. When each separate ejection plate 210 moves through the ejection position 270 and is caused to eject 92 a respective plurality 602 of material articles 90 from the cups 212, the plurality 602 of material articles 90 may thus be ejected as a plurality of linearly spaced-apart groups 222 corresponding to the groups of cups 212 of the ejection plate 210, where the groups 222 of material articles 90 are aligned with the radial direction 172 and are spaced apart along the radial direction 172 with a spacing distance 224 therebetween.

Still referring to at least FIGS. 5A-5B and 6A-6C, the plurality of funnels 116 may be shaped so that a boundary 117 between radially-overlapping portions of azimuthally adjacent funnels 116 (e.g., between the radially overlapping second azimuthal areas 168-2 of adjacent first and second funnels 116-1 and 116-2 in the radial direction 114 as shown in FIGS. 5A-5B) is configured to vertically overlap a spacing distance 224 between adjacent groups 222 of cups 212 of one or more ejection plates 210 at the ejection position 270 when the radially-overlapping portions of azimuthally adjacent funnels 116 are located in the material receiving position 170. Restated, the plurality of funnels 116 may be shaped so that radially-overlapping portions of azimuthally adjacent funnels 116 (e.g., the radially overlapping second azimuthal areas 168-2 of adjacent first and second funnels 116-1 and 116-2 as shown in FIGS. 5A-5B) vertically overlap separate, respective portions of the ejection position 270 through which separate, respective sets of one or more groups 222 of cups 212 may move as the ejection wheel 200 rotates, so that separate groups 222 of material articles 90 in an ejected 92 plurality 602 of material articles 90 are ejected into separate, radially-overlapping portions (e.g., second azimuthal areas 168-2) of different, azimuthally adjacent funnels 116 (e.g., funnels 116-1 and 116-2 as shown). As a result, the azimuthally adjacent funnels 116 may be configured to direct different portions (e.g., different groups 222) of a given plurality 602 of ejected material articles 90 that are received at the material receiving position 170 from the ejection system 20 into different funnels 116, and thus into different containers 82 that are axially aligned with the different funnels 116 while the plurality of funnels 116 are moving continuously through the material receiving position 170.

FIGS. 6A, 6B, and 6C are bottom cross-sectional views along cross-sectional view line VI-VI' of FIG. 1C, during rotation of a rotatable apparatus and an ejection wheel of an ejection system, according to some example embodiments. FIGS. 6A-6C illustrate the positions of the ejection wheel 200 and the rotatable drum 110 at three separate times during continuous, simultaneous rotation 122 of the rotatable drum 110 at a first rate of rotation and rotation 294 of the ejection wheel 200 at a second rate of rotation.

Referring now to FIGS. 6A-6C, the rotatable drum 110 may be configured to rotate 122 continuously around the first central rotation axis 112 at a first rate of rotation so that the plurality of funnels 116 are continuously moving through the material receiving position 170 to receive and direct one or more pluralities 602 of material articles 90 into separate, respective containers 82 that are in continuous motion along the arcuate path 84. As shown in FIGS. 6A-6C, the rotatable drum 110 may be configured to direct different portions of a single plurality 602 of ejected material articles 90 into different funnels 116 that are at least partially simultaneously located in the material receiving position 170. In some example embodiments, for example the example embodiments shown in FIGS. 6A-6C, where each separate plurality 602 of material articles ejected at a fixed time interval (e.g., based on separate ejection plates 210-1 to 210-3 moving sequentially through the ejection position 270 due to rotation of the ejection wheel 200 at a fixed, second rate of rotation) being a linear pattern aligned with the radial direction 172 of the rotatable drum 110, different portions of the plurality 602 of material articles 90 may be directed into different, azimuthally adjacent funnels 116 based on at least a portion of each of the azimuthally adjacent funnels overlapping in the radial direction 172 at the material receiving position 170, such that different portions of one or more pluralities 602 of material articles 90 may be directed into different funnels 116 according to different proximities of the different portions of material articles to the first central rotation axis 112 along the radial direction 172. As a result, containers 82 that are axially aligned with the respective funnels 116 may be filled with a particular quantity of material articles 90 based on each funnel 116 directing some or all of one or more pluralities 602 of material articles 90 into a respective, axially aligned container 82.

As a result, and as shown in FIGS. 6A-6C, the rotatable apparatus 100 may be configured to direct a same, particular quantity (e.g., a fixed quantity) of material articles 90 into each container 82 of a continuously-moving lane 80 based on the rotatable apparatus 100 continuously rotating around the first central rotation axis 112 to cause differently-shaped funnels 116 that have respective bottom openings 116B axially aligned with separate, respective containers 82 to move continuously through a fixed material receiving position 170 concurrently with the rotatable apparatus 100 receiving separate pluralities 602 of the material articles 90 from the ejection system 20 at a fixed time interval.

FIG. 6A illustrates the rotatable drum 110 and the ejection wheel 200 of the ejection system 20 according to some example embodiments at a first position where respective portions of a first funnel 116-1 and a third funnel 116-3 of the set 118 of funnels 116 shown in FIGS. 5A-5B (e.g., radially-overlapping second azimuthal areas 166-2 of the first funnel 116-1 and the third funnel 116-3) are simultaneously at the material receiving position 170 and at least partially overlapping in the fixed radial direction 172 during rotation 122 of the rotatable drum 110 concurrently with a first ejection plate 210-1 of the ejection wheel 200 being at the ejection position 270, such that the cups 212 of the first ejection plate 210-1 may eject separate, respective material articles 90 of a first plurality 602-1 of material articles into the material receiving position 170.

As shown in at least FIG. 5A and FIG. 6A, each ejection plate 210 of the ejection wheel 200 may include a quantity of six cups 212 arranged in three groups 222 of two cups 212 per group that are spaced apart by a spacing distance 224 in a direction that is parallel to the radial direction 172. As shown in FIG. 6A, while the azimuthally adjacent funnels 116-1 and 116-3 have respective top openings 116U-1 and 116U-3 that have different shapes (and where the top opening 116U-3 is azimuthally asymmetric), the azimuthally adjacent funnels 116-1 and 116-3 at least partially overlap in the radial direction 172 at the material receiving position 170 (e.g., proximate second azimuthal areas 166-2 of the first and third funnels 116-1 and 116-3 may radially overlap as shown in at least FIGS. 5A-5B) such that the respective top openings 116U-1 and 116U-3 of the first and third funnels 116-1 and 116-3 overlap different portions 602-1A and 602-1B of the first plurality 602-1 of material articles 90 that are ejected by the first ejection plate 210-1 into the material receiving position 170 concurrently with the radially-overlapping portions of the first and third funnels 116-1 and 116-3 being at the material receiving position 170.

As a result, and as shown in FIG. 6A, four material articles 90 of portion 602-1A are ejected from the first ejection plate 210-1 of the ejection system 20 into a vertically-overlapping portion of the material receiving position 170 that is occupied by a portion of the first funnel 116-1 (e.g., a second azimuthal area 166-2 of the first funnel 116-1) and thus are directed 612-1A by the first funnel 116-1 into a first container 82-1 that is axially aligned with the bottom opening 116B of the first funnel 116-1 (e.g., by the rotatable turret 120 that is shown in at least FIGS. 1A, 1C, and 3), while the remaining two material articles 90 of portion 602-1B are ejected from the first ejection plate 210-1 of the ejection system 20 into a vertically-overlapping portion of the material receiving position 170 that is occupied by a portion of the third funnel 116-3 (e.g., a second azimuthal area 166-2 of the third funnel 116-3) that radially overlaps a portion of the first funnel 116 in the radial direction 172 and thus are directed 612-1B by the third funnel 116-3 into a separate, third container 82-3 that is axially aligned with the bottom opening 116B of the third funnel 116-3 (e.g., by the rotatable turret 120 that is shown in at least FIGS. 1A, 1C, and 3). As a result, and as shown in at least FIG. 6A, the rotatable apparatus 100 may direct separate portions of a linear pattern of a plurality 602 of simultaneously-ejected material articles 90, received simultaneously or substantially simultaneously into the material receiving position 170 of the rotatable apparatus 100, into different, azimuthally adjacent funnels 116 according to respective radial proximities of the separate portions to the first central rotation axis 112 along the radial direction 172 that intersects the material receiving position 170 from the first central rotation axis 112.

FIG. 6B illustrates the rotatable drum 110 and the ejection wheel 200 at a second position, subsequently to the first position, where both the rotatable drum 110 and the ejection wheel 200 have advanced from the first position to the second position due to continuous, respective rotation 122 and 294 thereof. At the second position as shown in FIG. 6B, a portion of the first funnel 116-1 (e.g., the first azimuthal area 166-1 of the first funnel 116-1 as shown in FIGS. 5A-5B) is at the material receiving position 170 during rotation 122 of the rotatable drum 110 concurrently with a second ejection plate 210-2 of the ejection wheel 200 being at the ejection position 270. As a result, and as shown in FIG. 6B, all six material articles 90 of the second plurality 602-2 of material articles 90 that are ejected from the second ejection plate 210-2 of the ejection system 20 at the ejection position 270 are received into the vertically-overlapping portion of the first funnel 116-1 (e.g., the first azimuthal area 166-1 of the first funnel 116-1) at the material receiving position 170 and thus are directed by the first funnel 116-1 into the first container 82-1 that remains axially aligned with the bottom opening 116B of the first funnel 116-1 (e.g., by the rotatable turret 120 that is shown in at least FIGS. 1A, 1C, and 3). As a result, referring to FIGS. 6A and 6B, a total of 10 material articles 90 are directed by the first funnel 116-1 into the first container 82-1 based on rotation of the rotatable drum 110 through the first and second positions shown in FIGS. 6A and 6B.

FIG. 6C illustrates the rotatable drum 110 and the ejection wheel 200 at a third position, subsequently to the second position shown in FIG. 6B, where both the rotatable drum 110 and the ejection wheel 200 have advanced from the second position to the third position due to continuous, respective rotation 122 and 294 thereof.

At the third position shown in FIG. 6C, respective portions of the first funnel 116-1 and an azimuthally adjacent second funnel 116-2 of the set 118 of funnels 116 shown in FIGS. 5A-5B (e.g., radially-overlapping second azimuthal areas 166-2 of the first funnel 116-1 and the second funnel 116-2) are simultaneously at the material receiving position 170 and at least partially overlapping in the fixed radial direction 172 during rotation 122 of the rotatable drum 110 concurrently with a third ejection plate 210-3 of the ejection wheel 200 being at the ejection position 270, such that the cups 212 of the third ejection plate 210-3 may eject separate, respective material articles 90 of a third plurality 602-3 of material articles 90 into the material receiving position 170.

As shown in FIG. 6A, while the azimuthally adjacent funnels 116-1 and 116-2 have respective top openings 116U-1 and 116U-2 that have different shapes (and where the top opening 116U-2 is azimuthally asymmetric), the azimuthally adjacent funnels 116-1 and 116-2 at least partially overlap in the radial direction 172 at the material receiving position 170 (e.g., proximate second azimuthal areas 166-2 of the first and second funnels 116-1 and 116-2 may radially overlap as shown in at least FIGS. 5A-5B) such that the respective top openings 116U-1 and 116U-2 of the first and second funnels 116-1 and 116-3 overlap different portions 602-3A and 602-3B of the third plurality 602-3 of material articles 90 that are ejected by the third ejection plate 210-3 into the material receiving position 170 concurrently with the radially-overlapping portions of the first and second funnels 116-1 and 116-2 being at the material receiving position 170.

As a result, and as shown in FIG. 6C, four material articles 90 of portion 602-3A are ejected from the third ejection plate 210-3 of the ejection system 20 into a vertically-overlapping portion of the material receiving position 170 that is occupied by a portion of the first funnel 116-1 (e.g., another second azimuthal area 166-2 of the first funnel 116-1) and thus are directed 612-3A by the first funnel 116-1 into a first container 82-1 that is axially aligned with the bottom opening 116B of the first funnel 116-1 (e.g., by the rotatable turret 120 that is shown in at least FIGS. 1A, 1C, and 3), while the remaining two material articles 90 of portion 602-3B are ejected from the third ejection plate 210-3 of the ejection system 20 into a vertically-overlapping portion of the material receiving position 170 that is occupied by a portion of the second funnel 116-2 (e.g., a second azimuthal area 166-2 of the second funnel 116-2) that radially overlaps a portion of the first funnel 116 in the radial direction 172 and thus are directed 612-3B by the second funnel 116-2 into a separate, second container 82-2 that is axially aligned with the bottom opening 116B of the second funnel 116-2 (e.g., by the rotatable turret 120 that is shown in at least FIGS. 1A, 1C, and 3).

It may be understood that FIGS. 6A-6C show the packaging machine 1 at three sequential points in time corresponding to three sequential ejections 92 of respective pluralities 602-1, 602-2, 60-3 of material articles at the fixed time interval, thereby illustrating how separate portions of a given plurality of material articles 90 ejected by the ejection system 20 into the continuously-rotating rotatable apparatus 100 at a fixed time interval may be directed by the rotatable apparatus 100 into one or multiple different containers 82 based at least in part upon the shapes of the various funnels 116 of the rotatable apparatus 100.

Referring to FIGS. 6A, 6B, and 6C as a whole, the rotatable apparatus 100 may direct a total of 14 material articles 90 via the first funnel 116-1 into the first container 82-1 based on rotation of the rotatable drum 110 continuously and sequentially through the first, second, and third positions shown in FIGS. 6A, 6B, and 6C while the ejection system 20 sequentially ejects pluralities 602-1, 602-2, and 602-3 of material articles 90 at a fixed time interval (e.g., based on continuous rotation 294 of the ejection wheel 200 at a second rate of rotation). Still referring to FIGS. 6A-6C in summation, the first funnel 116-1 may direct at least a portion of sequentially received pluralities 602-1, 602-2, and 602-3 of material articles 90 (sequentially received at the fixed time interval) into a single axially aligned first container 82-1 to fill the first container 82-1 with a particular quantity of material articles (e.g., 14 material articles in the illustrated example embodiments) while the rotatable apparatus 100 maintains continuous motion of the first container 82-1, and thus of the lane 80 of containers. Referring back to FIGS. 1A-5B, the rotatable apparatus 100 may continuous rotating 122 to move the first container 82-1 along the arcuate path 84, subsequently to the third position shown in FIG. 6C, until the first container 82-1 reaches the ramp 156 and exits the rotatable apparatus 100 through the outlet 1600, after which the first funnel 116-1 may be axially aligned (by the rotatable turret 120) with a new, empty container 82 to be filled via the same process shown in FIGS. 6A-6C.

It will be appreciated, that, in subsequent positions of the second funnel 116-2 (subsequent to the third position shown in FIG. 6C) due to continuous rotation 122 of the rotatable drum 110 and the rotation 294 of the ejection wheel 200, the second funnel 116-2 may receive two additional entire pluralities of six material articles each, ejected from two additional ejection plates into respective and azimuthally adjacent first azimuthal areas 166-1 of the second funnel 116-2 (e.g., as shown in FIGS. 5A-5B), such that the second funnel 116-2 may also direct a total of 14 material articles into the separate, second container 82-2 axially aligned with the second funnel 116-2 based on the second funnel 116-2 moving continuously through the material receiving position 170 while the ejection system 20 continues to eject separate pluralities 602 of material articles 90 at the fixed time interval.

It will also be understood that the third funnel 116-3 may similarly direct a total of 14 material articles into a separate container 82-3 axially aligned with the third funnel 116-3 based on the third funnel 116-3 moving continuously through the material receiving position 170 while the ejection system 20 continues to eject separate pluralities 602 of material articles 90 at the fixed time interval. Thus, each of the first, second, and third funnels 116-1, 116-2, and 116-3 of each set 118 of funnels 116 may be configured to direct a same particular quantity of material articles 90 (e.g., 14 material articles) into separate, respective axially aligned containers 82-1, 82-2, and 82-3 based on continuous rotation 122 of the rotatable apparatus 100 at a first rate of rotation while the ejection system 20 ejects separate, respective pluralities 602 of material articles 90 at the fixed time interval (e.g., due to rotation 294 of the ejection wheel 200 at a second rate of rotation), so that the same particular quantity of material articles 90 may be directed by the rotatable apparatus 100 into separate, respective containers 82 while the rotatable apparatus 100 maintains continuous motion of the containers 82 (e.g., along arcuate path 84) and thus continuous motion of the lane 80.

As shown in FIGS. 6A-6C, the rotatable apparatus 100 may be configured to fill each separate container 82 with a same total quantity of material articles (e.g., 14 material articles) that is different from an integer multiple of the total number of material articles 90 in each ejected plurality 602 (e.g., 602-1, 602-2, 602-3) that is ejected by the ejection system 20 at a fixed time interval, and which may be defined by the quantity of cups 212 in each separate ejection plate 210 of the ejection wheel 200. For example, as shown in FIGS. 6A-6C, where each separate ejection plate 210 includes six cups 212 and thus the ejection system 20 may eject separate pluralities 602 (e.g., first to third pluralities 602-1 to 602-3) that each include six material articles at the fixed time interval, a ratio of the quantity of material articles 90 directed by each funnel 116 into a separate, axially aligned container 82 to the quantity of material articles 90 in each separate plurality 602 of material articles 90 ejected from the ejection system 20 (e.g., the quantity of material articles 90 ejected from each separate single ejection plate 210 of the plurality of ejection plates 210) may be a rational number that is neither an integer nor a fraction 1/x where x is an integer. For example, in FIGS. 1, 3-5B and 6A-6C, the quantity of material articles 90 in each separate plurality 602 ejected 92 from the ejection system 20 (e.g., the first to third pluralities 602-1 to 602-3) may be "6", while the total quantity of material articles 90 directed into each separate container 82 by each separate, respective axially aligned funnel 116 of the rotatable apparatus 100 is 14 material articles, and the ratio between such quantities is 14/6 (or 6/14) which cannot be reduced to an integer ratio. Such a ratio may be obtained based on synchronizing the rotations 122 and 294 of the rotatable apparatus 100 and the ejection wheel 200 so that each separate ejection plate 210 moves through the ejection position 270, and thus ejects a respective plurality 602 of six material articles, concurrently with a separate azimuthal portion (e.g., a separate azimuthal area 166-1 or 166-2) of one or more funnels 116 being at the material receiving position 170.

As a result of such a ratio, the packaging machine 1 may be configured to fill containers 82 in a lane 80 with a quantity of material articles (e.g., 14) which cannot be obtained by indexing one or more entire pluralities 602 of material articles (e.g., six material articles per pluralities 602) at a fixed time interval into a single container 82 but would instead require indexing a portion of one or more pluralities 602 of material articles 90 (e.g., indexed by a portion of material articles 90 ejected from one or more ejection plates 210 of the ejection wheel 200) into one or more containers 82.

For example, referring to the ejection wheel 200 and ejection plates 210 thereof shown in FIGS. 6A-6C, indexing a total of 14 material articles into a container 82 that is stationary at the material receiving position 170 would involve indexing 2 material articles (e.g., corresponding to a single group 222 of material articles as shown in FIG. 5A, corresponding further to at least the portions 602-1B and 602-3B shown in FIGS. 6A and 6C) from a sequence of seven (7) ejection plates 210 moving through the ejection position 270, while the indexed container 82 would remain stationary at the material receiving position 170 throughout the sequence of 7 indexing operations from the ejection system 20, and the remaining 4 material articles 90 from each of the 7 ejection plates 210 could be indexed into two other parallel lanes of index containers 82 which would also simultaneously be stationary at or near the material receiving position 170. Such an indexing process would involve providing three parallel indexed lanes of containers 82, each lane being indexed to the material receiving position 170 to receive 7 groups 222 of 2 material articles 90 per index while the ejection wheel 200 rotates 7 ejection plates 210 sequentially through the ejection position 270. As a result, based on rotating 7 ejection plates 210 through the ejection position 270, three indexed containers 82 may be filled with 14 material articles. Each container 82 that has been filled with a particular quantity of material articles 90 by the rotatable apparatus 100 and which has been moved through the outlet 1600 to exit the rotatable apparatus 100 may be referred to herein as a filled container 82.

In the example embodiments shown in FIGS. 1A-5B and 6A-6C, however, and referring for example to the container 82-1 shown in FIGS. 6A-6C, the rotatable apparatus 100 may fill each separate container 82 of a continuously moving lane 80 with 14 material articles based on the ejection wheel 200 sequentially rotating three ejection plates 210 (e.g., plates 210-1 to 210-3) through the ejection position 270 while the rotatable apparatus 100 rotates 122 at least a portion of a set 118 of funnels 116 in continuous motion through the material receiving position 170. As indicated above, each funnel 116 may define three separate azimuthal areas 166-1 and/or 166-2 that may receive at least a portion of three separate pluralities 602 of material articles 90 from three separate ejection plates 210, with at least one plurality 602 (e.g., pluralities 602-1 and 602-3 as shown in FIGS. 6A and 6C with regard to the first funnel 116-1) being divided between two azimuthally adjacent funnels 116 according to partial overlap of the adjacent funnels 116 in the radial direction 172. As a result, the set 118 of funnels 116-1, 116-2, 116-3 may fill three, respective axially aligned containers 82 with a same particular quantity of 14 material articles 90 each based on rotating 122 continuously through the material receiving position 170 while the ejection system 20 sequentially ejects seven pluralities 602 of material articles 90 at a fixed time interval (e.g., based on the ejection wheel 200 sequentially and continuously moving seven (7) ejection plates 210 through the ejection position 270) where the rotatable apparatus 100 may direct each separate plurality 602 of material articles 90 into a separate azimuthal area 166-1 and/or 166-2 of one or more funnels 116 corresponding to a separate angle of rotation of the rotatable apparatus 100 (said angle of rotation of the rotatable apparatus 100 between each separate plurality 602 being received at the material receiving position 170 may correspond to the central angle 112A that each separate azimuthal area 166-1 and 166-2 defines).

However, the filling of the three containers 82 by the set 118 of funnels 116-1, 116-2, and 116-3 (e.g., containers 82-1, 82-2, and 82-3) of the rotatable apparatus 100 may be accomplished while maintaining continuous motion of the lane 80 of containers 82, such that total throughput rate of the lane 80 by the packaging machine 1 is not limited by indexing the lane 80 and thus the throughput rate may be adjusted based on adjusting the speed of rotation 122 of the rotatable apparatus 100 and/or the fixed time interval at which the ejection system 20 ejects separate pluralities 602 of material articles 90 (e.g., based on adjusting the second rate of rotation 294 of the ejection wheel 200). Additionally or alternatively, the ratio of ejected pluralities of material articles to quantities of material articles in each container 82 may be adjusted based on replacing the rotatable drum 110 with a different rotatable drum 110 including funnels 116 having different shapes, thereby enabling improved ease of adjusting the quantity of material articles in each container 82. For example, the rotatable drum 110 may be detachably coupled to a remainder of the rotatable apparatus 100 (e.g., detachably coupled to the air vent conduits 130, the shaft 106, the rotatable turret 120, or the like) to enable swapping of a given rotatable drum 110 having a particular quantity of funnels 116 having certain shapes for another rotatable drum 110 having a different quantity of funnels 116 and/or having funnels that have different shapes from the swapped-out rotatable drum 110. As a result, the rotatable apparatus 100 may be quickly and simply reconfigured to fill the containers 82 with different quantities of material articles 90 based on the rotatable drum 110 being detachably coupled to the rotatable apparatus 100 such that the rotatable drum 110 may be swapped for a different rotatable drum 110 having a different quantity and/or shapes of funnels 116, where the different quantities and/or shapes of funnels 116 of a given rotatable drum 110 may configure the rotatable apparatus 100 to direct a different quantity of material articles 90 into each container 82 based on the rotatable apparatus 100 rotating 122 at a particular first rate of rotation. Additionally or alternatively, the ratio of ejected pluralities of material articles to quantities of material articles in each container 82 may be adjusted based on replacing the ejection plates 210 of an ejection wheel 200 with different ejection plates 210 having different quantities and/or arrangements of cups 212, thereby enabling improved ease of adjusting the quantity of material articles in each container 82.

It will further be understood that the rotatable apparatus 100 may be configured to direct any quantity (e.g., any even quantity, any odd quantity) of material articles 90 into a continuously moving lane 80 of containers 82 moved in axial alignment with separate, respective funnels 116 along an arcuate path 84, based on the shape(s) of the funnels 116 of the rotatable apparatus 100 (which may be a same shape, or at least two different shapes, at least three different shapes as shown in FIGS. 6A-6C, or the like, but is not limited thereto) and/or the rate of rotation 122 of the rotatable apparatus 100 and the fixed time interval at which separate pluralities 602 of material articles 90 are ejected from the ejection system 20 to the material receiving position 170.

As shown in FIGS. 6A-6C, a rotatable drum 110 (which may be detachably coupled to a remainder of the rotatable apparatus 100 to enable swapping of different rotatable drums 110 having different quantities of funnels and/or differently-shaped funnels 116) may comprise multiple different pieces (e.g., six pieces shown in FIGS. 6A-6C) that may individually define a different azimuthal portion of the rotatable drum 110 and may be coupled together to establish the rotatable drum 110.

Referring back to FIGS. 1A and 1C, the packaging machine 1 may include a packing device 40 configured to move vertically to pack material articles 90 held in each filled container 82 as the filled container 82 is moved continuously along the discharge path 88 of the lane 80, downstream of the outlet 1600 of the rotatable apparatus 100, to the lane outlet 520 of the container filling system 10. The packaging machine 1 may further include a sealing system 50 configured to seal the top opening of each filled containers 82 of the lane 80 downstream of the outlet 1600 of the rotatable apparatus 100 (e.g., after the filled container 82 has been packed by the packing device 40). The packaging machine 1 may further include a weight checking system 60 that is configured to receive filled containers 82 (e.g., sealed containers 82) of the lane 80 subsequently to the containers 82 exiting the rotatable apparatus 100 via outlet 1600 and/or the container filling system 10 via the lane outlet 520 and to further weigh such filled containers 82. The weight checking system 60 may include any known weight scale device configured to generate sensor data that may indicate a weight of a container 82 received at the weight checking system 60. The weight checking system 60 may be configured to weigh one or more filled containers 82 of a continuously moving lane 80 of containers 82, for example to sequentially weight each separate filled container 82 of the lane of containers 82 exiting the container filling system 10 via the lane outlet 520.

The packaging machine 1 may include a controller 70 that may be communicatively coupled to the container filling system 10 (e.g., to the drive motor 490), to the ejection system 20 (e.g., to the drive motor 290), to the material dispenser apparatus 30, to the weight checking system 60, to the packing device 40, to the sealing system 50, any combination thereof, or the like (e.g., via any known wired or wireless communication system). The controller 70 may be configured to adjust an operating speed of the ejection system 20 and/or the container filling system 10 (e.g., to adjust the respective rates of rotation 294 and 122, to adjust the fixed time interval at which the ejection system 20 ejects separate pluralities 602 of material articles 90, etc.) to adjust the speed of the lane 80 of containers 82 and thus to adjust the throughput rate of the packaging machine 1. The controller 70 may further adjustably control the packing device 40, the sealing system 50, the material dispenser apparatus 30, the weight checking system 60, or any combination thereof, to accommodate any change in throughput rate implemented based on adjusting the rate of rotation 122 of the rotatable apparatus 100, the fixed time interval of ejection by the ejection system 20 (e.g., the rate of rotation 294 of the ejection wheel 200), or the like.

In some example embodiments, the controller 70 is configured to process sensor data received from the weight checking system 60 to determine whether the weight value corresponding to one or more containers 82 weighed by the weight checking system 60 (e.g., an average of weights of a selection, sequence, etc. of a particular quantity and/or sequence of weighed containers 82) is within a certain target weight range (e.g., a target weight range corresponding to each container 82 being filled with 14 material articles that are each fully filled with a particular material dispensed by the material dispenser apparatus 30, with a 5% tolerance margin, a 10% tolerance margin, or the like). The target weight range may be empirically determined, experimentally determined, or the like and may be stored at the controller 70, the weight checking system 60, or the like (e.g., at a memory thereof) and accessed therefrom to make the aforementioned determination. In response to a determination that the weight value corresponding to the one or more containers is outside the target weight range, the controller 70 may control the container filling system 10 (e.g., the rate of rotation 122 of the rotatable apparatus 100 based on controlling the rotation speed of the drive motor 490), the ejection system 20 (e.g., the rate of rotation 294 of the ejection wheel 200 based on controlling the rotation speed of the drive motor 290), the material dispenser apparatus 30 (e.g., the rate at which material is supplied to proximate cups 212 of the ejection wheel 200), any combination thereof, or the like in order to cause the resultant containers 82 filled by the container filling system 10 to correspond to a determined weight value that approaches and/or is within the target weight range.

As shown, based on the container filling system 10 (e.g., the rotatable apparatus 100) being configured to enable filling a continuously-moving lane 80 of containers 82 with a particular quantity of material articles 90, such that a single continuously-moving lane 80 may be provided instead of multiple, parallel indexed lanes, the weight checking system 60 may be positioned relatively close to the lane outlet 520 of the container filling system 10, such that the weight checking system 60 may be configured to generate sensor data that may be processed to detect weight value changes corresponding to changes in the weights of the filled containers 82 exiting the rotatable apparatus 100 soon after the containers 82 are filled. For example, the weight checking system 60 may be located 10-20 containers "downstream" of the material receiving position 170 of the rotatable apparatus 100, such that a change in the packaging machine 1 that causes a quantity of material articles 90 received into each container 82 to change may be detected by the weight checking system 60 after 10-20 containers are filled subsequent to the change, and thus the controller 70 may respond based on controlling one or more aspects (e.g., operational parameters, operating speeds, etc.) of one or more portions of the packaging machine 1 to adjust the quantity of material articles 90 directed into each container 82 to return to the target weight range after a relatively small number of containers 82 have been filled to a weight that is beyond the target weight range (e.g., 10-20 containers). Such a configuration, enabled based on the weight checking system 60 being relatively close downstream of the material receiving position 170 in terms of the quantity of containers 82 of the continuously-moving lane 80 between the material receiving position 170 and the weight checking system 60 along the lane 80, may enable improved responsiveness of the packaging machine 1, in relation to example embodiments where the container filling system 10 indexes multiple lanes of containers to receive separate portions of the material articles ejected from the ejection system 20 wherein the weight checking system 60 may be located downstream of merging equipment that merges the multiple parallel indexed lanes in order to direct all containers through a single weight checking system 60, where such a weight checking system 60 may be much further downstream from the material receiving position 170 than in the example embodiments that include the rotatable apparatus 100, for example 100-120 containers downstream from the material receiving position.

In view of at least the above, it will be understood that a container filling system 10 that includes a rotatable apparatus 100 configured to fill containers of a continuously-moving lane with a particular quantity of material articles may configure the packaging machine 1 to have improved responsiveness to operational changes, including improved compensation for changing operational conditions, to improve the reliability of the filled containers having a particular weight and/or quantity of material articles held therein, relative to packaging machines that index multiple parallel lanes of containers to receive separate, respective portions of indexed liabilities of material articles from an ejection system 20.

Figure 7:
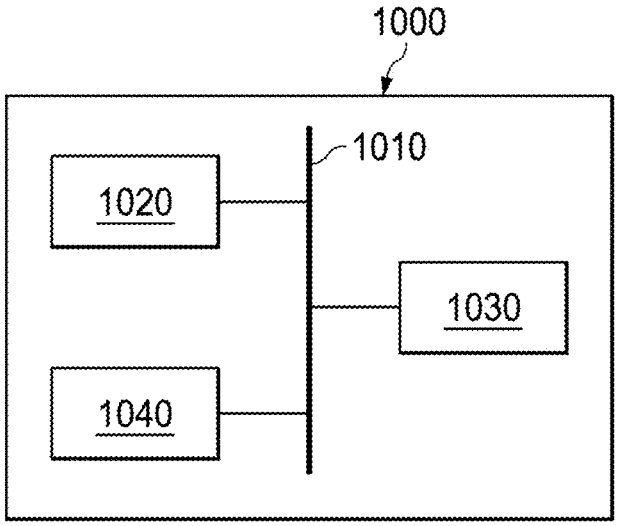
FIG. 7 is a schematic view of an electronic device of a packaging machine according to some example embodiments.

FIG. 7 is a schematic view of an electronic device 1000 that may be included in a packaging machine 1 according to some example embodiments.

The electronic device 1000 may include, may be included in, and/or may implement any portion of the packaging machine 1, including for example the controller 70, the weight checking system 60, any portion thereof, or the like. For example, referring back to FIG. 1A, the controller 70 may be configured to control some or all of the packaging machine 1, including some or all of the container filling system 10, the ejection system 20, the material dispenser apparatus 30, the packing device 40, the weight checking system 60, the sealing system 50, any combination thereof, or the like, and the electronic device 1000 may be configured to implement such functionality of the controller 70. The electronic device 1000 may also be included in and/or may at least partially implement any other portion of the packaging machine 1, for example the weight checking system 60.

In some example embodiments, some or all of any of the electronic device 1000 may include, may be included in, and/or may be implemented by one or more instances (e.g., articles, pieces, units, etc.) of processing circuitry such as hardware including logic circuits; a hardware/software combination such as a processor executing software; or a combination thereof. For example, the processing circuitry more specifically may include, but is not limited to, a central processing unit (CPU), an arithmetic logic unit (ALU), a digital signal processor, a microcomputer, a field programmable gate array (FPGA), a System-on-Chip (SoC), a programmable logic unit, a microprocessor, application-specific integrated circuit (ASIC), or any other device or devices capable of responding to and executing instructions in a defined manner.

Referring back to FIG. 7, the electronic device 1000 may include some or all of a processor 1020 (e.g., a CPU), a memory 1030 (e.g., a solid-state drive, or SSD), and a communication interface 1040 that are communicatively coupled together via a bus connection 1010. It will be understood that any type of non-transitory computer readable storage device may be used as the memory 1030 in addition or alternative to an SSD. In some example embodiments, the processing circuitry may include a non-transitory computer readable storage device, or memory (e.g., memory 1030), for example a solid state drive (SSD), storing a program of instructions, and a processor (e.g., processor 1020) that is communicatively coupled to the non-transitory computer readable storage device (e.g., via a bus connection 1010) and configured to execute the program of instructions to implement the functionality of some or all of any of the devices and/or mechanisms of any of the example embodiments and/or to implement some or all of any of the methods of any of the example embodiments, for example to implement the functionality of the controller 70 to control the packaging machine 1 and/or any portion thereof to perform any of the functions, operations, methods or the like that may be performed by the packaging machine 1 and/or any portion thereof according to any of the example embodiments. It will be understood that, as described herein, an element (e.g., processing circuitry, digital circuits, etc.) that is described as "implementing" an element (e.g., packaging machine 1) will be understood to implement the functionality of said implemented element (e.g., the functionality of the packaging machine 1).

Figure 8:
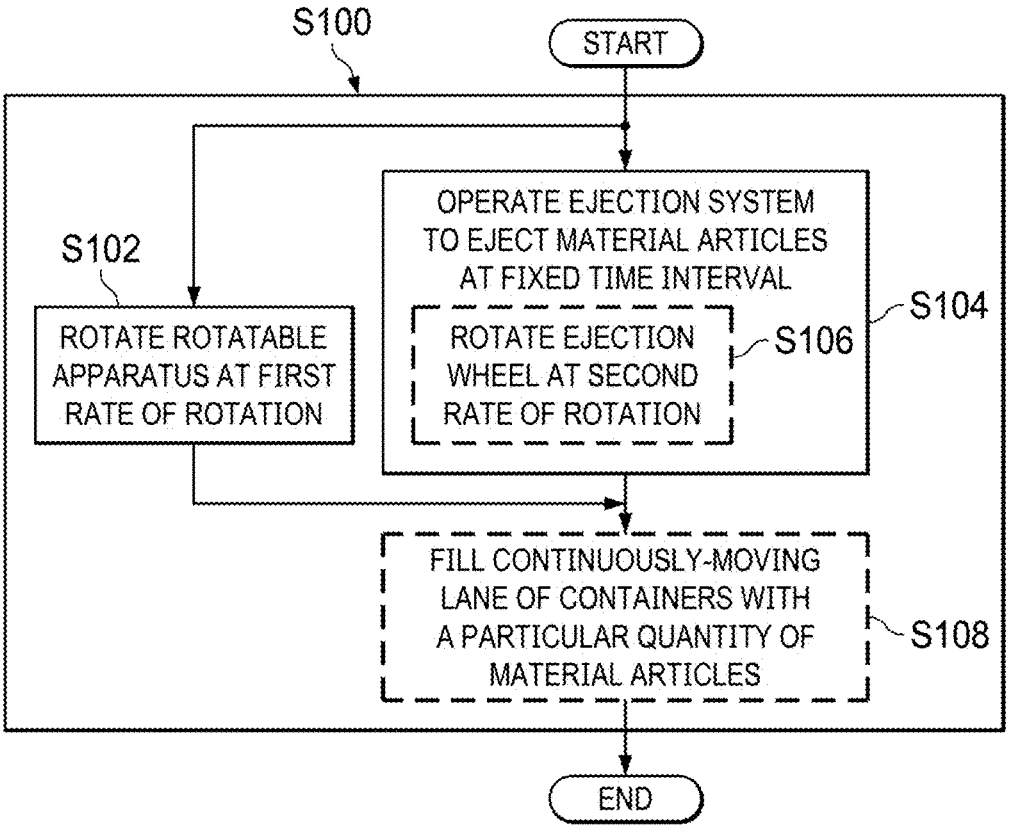
FIG. 8 is a flowchart illustrating a method of operating a packaging machine according to some example embodiments.

FIG. 8 is a flowchart illustrating a method of operating a packaging machine according to some example embodiments.

The method shown in FIG. 8 may be implemented with regard to some example embodiments of the packaging machine 1, including the packaging machine 1 shown in FIGS. 1 and 3-6C, including packaging machines including one or more electronic devices 1000 as shown in FIG. 7 and an ejection system 20 as shown in FIGS. 2A-2B, but example embodiments are not limited thereto. The operations shown in FIG. 8 may be implemented based on operation of an electronic device 1000 (e.g., an electronic device 1000 implementing the controller 70) to control operation of the packaging machine 1 and/or any portion thereof (e.g., operation of the container filling system 10 and the ejection system 20).

It will be understood that the operations of the method shown in FIG. 8 may be arranged in any order and/or may be rearranged in order relative to the order shown in FIG. 8. One or more of the operations shown in FIG. 8 may be omitted from the method shown in FIG. 8. One or more operations may be added to the method shown in FIG. 8.

At S100, the packaging machine is operated to fill one or more containers of a continuously moving lane (also interchangeably referred to herein as a continuously moving lane of one or more containers) with a particular quantity of material articles.

At S102, the operating of the packaging machine includes operating the container filling system (e.g., container filling system 10) to rotate a rotatable apparatus (e.g., rotatable apparatus 100) at a particular (e.g., fixed, constant, etc.) first rate of rotation around a central axis (e.g., first central rotation axis 112). The rotatable apparatus 100 may include a rotatable drum 110 including a circumferential pattern 113 of a plurality of funnels 116 and may further include a rotatable turret 120 as described herein, such that the operating at S102 may include rotating a rotatable drum 110 including a circumferential pattern 113 of a plurality of funnels 116 around the first central rotation axis 112 at a first rate of rotation to cause one or more containers 82 to be moved continuously along an arcuate path 84 at a fixed speed (which herein may be referred to interchangeably as moving at a fixed or substantially fixed angular rate of rotation around the first central rotation axis 112) while remaining axially aligned with the separate, respective bottom openings 116B of the plurality of funnels 116. For example, the operating at S102 may include rotating the rotatable apparatus around the first central rotation axis at a first rate of rotation to continuously move the circumferential plurality of funnels through the material receiving position and to further cause one or more containers to be engaged by one or more arms of a rotatable turret of the rotatable apparatus (e.g., rotatable turret 120) to move continuously along an arcuate path at a fixed speed while remaining axially aligned with separate, respective bottom openings of the plurality of funnels.

At S104, the operating of the packaging machine includes operating an ejection system (e.g., ejection system 20) to eject separate sets of one or more material articles (e.g., separate pluralities 602 of material articles 90) at a fixed time interval. In some example embodiments, the ejection system may include an ejection wheel (e.g., ejection wheel 200) and may be configured to eject the separate sets of one or more material articles based on operating the ejection system to rotate the ejection wheel at a particular (e.g., fixed, constant, etc.) second rate of rotation around a respective central axis (e.g., second central rotation axis 202), such that separate ejection plates of the ejection wheel move through a fixed ejection position and are caused to eject respective sets of one or more material articles at the fixed time interval based on the rotation of the ejection wheel at the second rate of rotation. As a result, in some example embodiments, the operation of the ejection system at S104 may include, at S106, causing an ejection wheel of the ejection system to rotate at the second rate of rotation. Accordingly, the operating at S106 may include rotating an ejection wheel around a second central rotation axis at a second rate of rotation to continuously move a plurality of ejection plates of the ejection wheel through an ejection position concurrently with operating an ejection device to direct a gas 236 through the gas discharge port 234 at the ejection position 270, to cause the gas 236 to be directed into one or more cups 212 of one or more ejection plates 210 based on the one or more ejection plates 210 being moved through the ejection position 270.

As shown in FIG. 8, the rotation of the rotatable apparatus at S102 and the operation of the ejection system at S104, including for example the rotation of an ejection wheel at S106, may be performed concurrently (e.g., simultaneously or substantially simultaneously) so that the rotatable apparatus is rotating at the first rate of rotation while the ejection system is ejecting separate, respective sets of one or more material articles at the fixed time interval (e.g., based on rotating an ejection wheel of the ejection system at the second rate of rotation). As shown in FIGS. 1A-1C, 3-5B, and 6A-6C, the rotatable apparatus 100 may include a rotatable turret 120 that may engage and move a plurality (e.g., a lane 80) of containers 82 continuously along an arcuate path 84 based on the rotatable apparatus 100 rotating 122 at the first rate of rotation at S102. As a result, the rotation of the rotatable apparatus at S102 may include causing a lane 80 of containers 82 to move in continuous motion (e.g., at a particular speed) at least along an arcuate path 84 based on the rotatable apparatus 100 rotating at the first rate of rotation.

In some example embodiments, the rotatable apparatus is configured to receive the separate sets of one or more materials ejected from the ejection system at S104 while the rotatable apparatus rotates at S102, where the material articles ejected from the ejection system are received at a fixed material receiving position at the rotatable apparatus, and the rotation of the ratable apparatus at S102 causes a circumferential plurality of funnels (e.g., funnels 116) of a rotatable drum (e.g., rotatable drum 110) of the rotatable apparatus to continuously (e.g., sequentially) rotate through the material receiving position, such that the rotatable apparatus may direct all or a portion of each separate set of one or more material articles received at the material receiving position into one or multiple different funnels and thus into one or multiple different containers. As described herein, at least some funnels of the plurality of funnels may have different shapes so that the rotatable apparatus may direct different portions of an individual set of multiple material articles (e.g., an individual plurality 602 of material articles 90) received simultaneously at the material receiving position into different funnels that are each at least partially located at the material receiving position at the time that the set of multiple material articles is so received. As described with reference to FIGS. 6A-6C, the rotation of the rotatable apparatus may cause some or all of multiple separately ejected pluralities of material articles, and thus a particular quantity of material articles, to be directed into a given container that is axially aligned with a given funnel of the rotatable apparatus during the rotation of the rotatable apparatus at S102, based on the shape of the given funnel (e.g., at least the same of the top opening of the given funnel) and/or the rate of rotation of the plurality of funnels around the central axis of the rotatable drum and thus the speed at which the given funnel moves through the material receiving position. The plurality of funnels may be respectively shaped so that each funnel is configured to receive and direct a same total quantity (e.g., a particular quantity) of material articles therethrough, and into a respective container axially aligned therewith (e.g., based on operation of the rotatable turret of the rotatable apparatus).

As a result, in some example embodiments where the rotatable apparatus is causing a lane of container to move continuously along an arcuate path while being axially aligned with separate, respective funnels of the rotatable apparatus, the rotation of the rotatable apparatus at S102 may include, at S108, filling each container of the continuously-moving lane of containers with a particular quantity of material articles ejected from the ejection system at S104.

While the ejection system is described at S104 to eject separate sets of one or more material articles at a fixed time interval, it will be understood that the set of one or more material articles may be a plurality of material articles (e.g., the plurality 602 of material articles 90), such that the ejection system may, at S104, eject separate pluralities of material articles at a fixed time interval.

Figure 9:
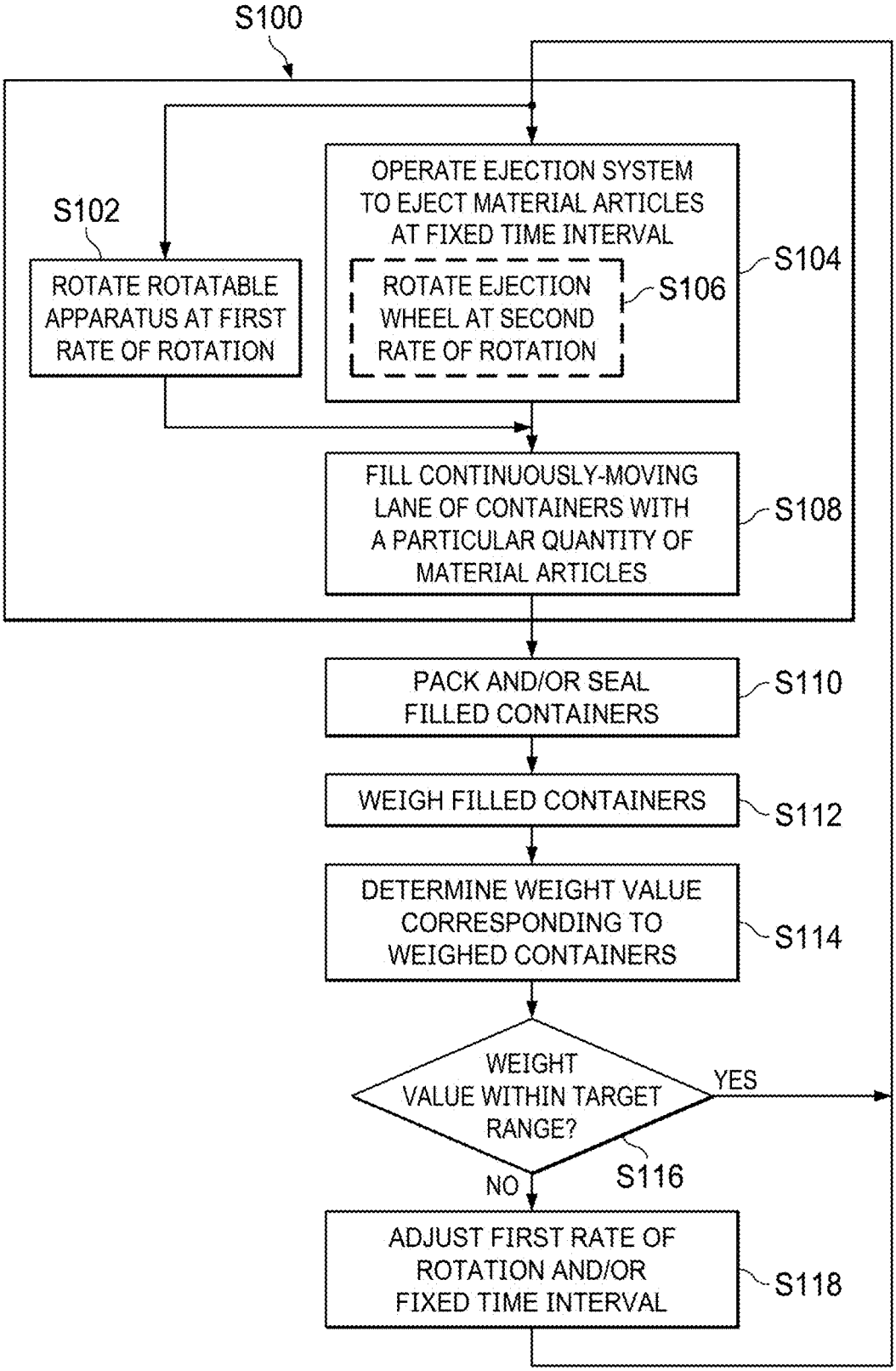
FIG. 9 is a flowchart illustrating a method of operating a packaging machine according to some example embodiments.

FIG. 9 is a flowchart illustrating a method of operating a packaging machine according to some example embodiments.

The method shown in FIG. 9 may be implemented with regard to some example embodiments of the packaging machine 1, including the packaging machine 1 shown in FIGS. 1 and 3-6C, including packaging machines including one or more electronic devices 1000 as shown in FIG. 7 and an ejection system 20 as shown in FIGS. 2A-2B, but example embodiments are not limited thereto. The operations shown in FIG. 8 may be implemented based on operation of an electronic device 1000 (e.g., an electronic device 1000 implementing the controller 70) to control operation of the packaging machine 1 and/or any portion thereof (e.g., operation of the container filling system 10 and the ejection system 20.

It will be understood that the operations of the method shown in FIG. 9 may be arranged in any order and/or may be rearranged in order relative to the order shown in FIG. 9. One or more of the operations shown in FIG. 9 may be omitted from the method shown in FIG. 9. One or more operations may be added to the method shown in FIG. 9.

Referring to FIG. 9, operations S100, S102, S104, S106, and S108 are the same as described with reference to operations S100, S102, S104, S106, and S108 of the method of FIG. 8, and the descriptions thereof are not duplicated in the description of the method of FIG. 9.

It will be understood that the operating of the packaging system at S100, which includes rotating the rotatable apparatus at S102, concurrently with operating the ejection system at S104 to eject sets of one or more material articles at a fixed time interval, may result in the rotatable apparatus filling a continuously-moving lane of containers each with a particular quantity of material articles at S108 and furthermore directing the continuously-moving lane of filled containers out of the rotatable apparatus (e.g., via an outlet 1600 of the rotatable apparatus 100).

At S110, the packaging machine may operate a packing device (e.g., packing device 40) to pack any material articles into the filled containers and/or may operate a sealing system (e.g., sealing system 50, also referred to herein as a packaging device) to seal the enclosure of the filled containers.

At S112, the packaging machine may operate a weight checking system (e.g., weight checking system 60) to weigh at least one filled container subsequently to the at least one filled container being filled with the particular quantity of material articles at S108. As shown, the weighing may be performed subsequently to packing and/or sealing the at least one filled container, but example embodiments are not limited thereto. For example, the weighing at S112 may be performed subsequently to filling the at least one filled container with the particular quantity of material articles at S108 and prior to packing and/or sealing the at least one filled container at S110. The weighing at S112 may include generating a signal (e.g., sensor data) at the weight checking system based on performing weighing of the at least one filled container and transmitting the signal to a controller (e.g., controller 70) which may be internal or external to the weight checking system.

At S114, one or more signals generated based on performing the weighing at S112 of at least one filled container is processed (e.g., at controller 70) to determine a weight value associated with (e.g., corresponding to) the filled containers that are filled by the rotatable apparatus 100 at S108. The weight value may be an individual weight of an individual filled container that is weighed by the weight checking system. The weight value may be a rolling average of individual weights of a plurality of filled containers of the lane that are sequentially or concurrently weighed by the weight checking system (e.g., the most recent ten weights measured by the weight checking system).

At S116, a determination is made regarding whether the weight value determined at S114 is within a target weight range (e.g., within a 10% margin of a specific target weight value that is associated with the containers each being filled at S108 with a particular quantity of material articles). The specific target weight value may be an empirically determined value that may be stored at an electronic device included in the packaging machine (e.g., electronic device 1000 implementing controller 70). Accordingly, the target weight range may be an empirically determined range of weight values that may be stored at an electronic device included in the packaging machine (e.g., electronic device 1000 implementing controller 70).

If so (S116=YES), the method shown in FIG. 9 partially or completely repeats, where the rotatable apparatus continues to rotate ta the first rate of rotation at S102, the ejection system continues to eject material articles at the fixed time interval at S104 (e.g., based on rotating the ejection wheel at the second rate of rotation at S106), thereby filling the continuously moving lane of containers with material articles, packing and/or sealing the filled containers at S110, weighing the containers at S112, determining a weight value at S114, and repeating the determination at S116.

If not (S116=NO), then at S118 the packaging machine is controlled to adjust the first rate of rotation of the rotatable apparatus and/or the fixed time interval at which the sets of one or more material articles are ejected by the ejection system (e.g., based on adjusting the second rate of rotation of the ejection wheel) in order to control the quantity of material articles directed into each of the containers of the continuously moving lane at S108. For example, the adjusting at S118 may include controlling a drive motor that is mechanically coupled to the rotatable apparatus (e.g., drive motor 490) to reduce or increase the first rate of rotation of the rotatable apparatus while keeping the fixed time interval of material article ejection by the ejection system unchanged. For example, the first rate of rotation may be reduced by a certain amount (e.g., 0.5 degrees/sec) in response to a determination that the weight value is smaller than the smallest value of the target weight range at S116, to increase the dwell time of each funnel of the rotatable apparatus within the fixed material receiving position as the rotatable apparatus rotates, thereby potentially resulting in an increase of the quantity of material articles received into the funnel per transit through the material receiving position and thus increasing the quantity of material articles directed by the funnel into a container being held by a rotatable turret in axial alignment with the funnel. In another example, the first rate of rotation may be increased by a certain amount (e.g., 0.5 degrees/sec) in response to a determination that the weight value is greater than the smallest value of the target weight range at S116, to reduce the dwell time of each funnel of the rotatable apparatus within the fixed material receiving position as the rotatable apparatus rotates, thereby potentially resulting in a decrease of the quantity of material articles received into the funnel per transit through the material receiving position and thus increasing the quantity of material articles directed by the funnel into a container being held by a rotatable turret in axial alignment with the funnel.

While the adjusting at S118 has been described with regard to adjusting the first rate of rotation and/or the fixed time interval (e.g., the second rate of rotation), it will be understood that the adjusting may include adjusting one or more operational parameters of any portion of the packaging machine.

Upon adjustment of the first rate of rotation and/or of the fixed time interval (e.g., based on controlling one or more portions of the container filling system, ejection system, or the like of the packaging machine), the process may revert to S100 as shown in FIG. 9.

Some Example Embodiments of the inventive concepts are as follows below:

Example Embodiment 1: A rotatable apparatus (100), comprising:

a rotatable drum (110) having a first central rotation axis (112) and including a circumferential pattern (113) of a plurality of funnels (116) having rotational symmetry around the first central rotation axis, each funnel of the plurality of funnels defining a top opening (116U) at a top end (110U) of the rotatable drum and a bottom opening (116U) at a bottom end (110B) of the rotatable drum; and a rotatable turret (120) rotationally fixed to the rotatable drum, the rotatable turret including a circumferential plurality of arms (124) having rotational symmetry around the first central rotation axis and at least partially defining a plurality of recesses (126) that have rotational symmetry around the first central rotation axis and axially overlap separate, respective funnel bottom openings of the plurality of funnels of the rotatable drum.

Example Embodiment 2: The rotatable apparatus of Example Embodiment 1, wherein two azimuthally adjacent funnels (116-1, 116-2) of the plurality of funnels define respective two azimuthally adjacent top openings (116U-1, 116U-2) having different intrinsic shapes.

Example Embodiment 3: The rotatable apparatus of Example Embodiment 2, wherein one top opening of the respective two azimuthally adjacent top openings is azimuthally symmetric.

Example Embodiment 4: The rotatable apparatus of Example Embodiment 2, wherein one top opening of the respective two azimuthally adjacent top openings is azimuthally asymmetric.

Example Embodiment 5: The rotatable apparatus of Example Embodiment 2, wherein the respective two azimuthally adjacent top openings at least partially overlap in a radial direction (114) extending radially from the first central rotation axis.

Example Embodiment 6: The rotatable apparatus of Example Embodiment 5, wherein each top opening of the respective two azimuthally adjacent top openings defines at least one first azimuthal area (166-1) and at least one second azimuthal area (166-2) that is partially azimuthally adjacent to the at least one first azimuthal area, the at least one first azimuthal area having a greater radial width than the at least one second azimuthal area, and at least one second azimuthal area of one of the respective two azimuthally adjacent top openings at least partially overlaps at least one second azimuthal area of another one of the respective two azimuthally adjacent top openings in the radial direction.

Example Embodiment 7: The rotatable apparatus of Example Embodiment 6, wherein a first azimuthal area (166-1) of at least one top opening of the respective two azimuthally adjacent top openings has a first radial width (168-1) that is a radial width between a radially outermost inner surface (116SO) and a radially innermost inner surface (116SI) of the at least one top opening, and at least one second azimuthal area of the at least one top opening has a second radial width (168-2) that extends radially from one of the radially outermost inner surface or the radially innermost inner surface of the at least one top opening.

Example Embodiment 8: The rotatable apparatus of Example Embodiment 1, wherein the plurality of funnels includes a set (118) of funnels, the set of funnels including a first funnel (116-1) having a first funnel top opening (116U-1), a second funnel (116-2) having a second funnel top opening (116U-2), and a third funnel (116-3) having a third funnel top opening (116U-3), the first funnel is azimuthally between the second funnel and the third funnel, the first funnel top opening is azimuthally symmetric, and the second funnel top opening and the third funnel top opening are each azimuthally asymmetric and have reflective azimuthal symmetry around an axis of symmetry (128) that extends radially from the first central rotation axis.

Example Embodiment 9: The rotatable apparatus of Example Embodiment 1, further comprising:

a plurality of air vent conduits (130) extending from separate, respective bottom openings of the plurality of funnels to separate, respective recesses of the rotatable turret, each air vent conduit including one or more openings (130A) extending through a thickness (130T) of a cylindrical sidewall of the air vent conduit.

Example Embodiment 10: A packaging machine (1), comprising:

the rotatable apparatus of Example Embodiment 1; and an ejection system (20), the ejection system configured to eject separate pluralities of material articles (90) at a fixed time interval.

Example Embodiment 11: The packaging machine of Example Embodiment 10, wherein the ejection system includes an ejection wheel (200) having a second central rotation axis (202), the ejection wheel including a separate circumferential pattern of a plurality of ejection plates (210) having respective outer surfaces (2160) facing radially outward from the second central rotation axis and collectively defining an outer cylindrical rim (2040) of the ejection wheel, each ejection plate defining a plurality of cups (212) open to an outer surface (2160) of the ejection plate, each ejection plate defining one or more air conduits (214) extending from each cup of the plurality of cups to an inner surface (2161) of the ejection plate facing radially inward toward the second central rotation axis, and an ejection device (230) fixed in position in relation to the ejection wheel, the ejection device including a gas supply manifold (232) having a gas discharge port (234) defining an ejection position (270) of the ejection device that is fixed in relation to the ejection wheel and at least partially defines a material receiving position (170) of the rotatable apparatus overlapping the ejection device in a vertical direction (174) extending in parallel to the first central rotation axis, such that the material receiving position is fixed in relation to the ejection device.

Example Embodiment 12: A method of operating the packaging machine of Example Embodiment 10, the method comprising:

rotating the rotatable apparatus around the first central rotation axis at a first rate of rotation to continuously move the plurality of funnels through a material receiving position and to cause the rotatable turret to cause a plurality of containers to move continuously along an arcuate path (84) while axially aligned with separate, respective bottom openings of the plurality of funnels; and operating the ejection system to eject the separate pluralities of material articles into the material receiving position concurrently with the rotatable apparatus rotating around the first central rotation axis at the first rate of rotation.

Example Embodiment 13: The method of Example Embodiment 12, wherein the ejection system includes an ejection wheel (200) having a second central rotation axis (202), the ejection wheel including a separate circumferential pattern of a plurality of ejection plates (210) having respective outer surfaces (2160) facing radially outward from the second central rotation axis and collectively defining an outer cylindrical rim (2040) of the ejection wheel, each ejection plate defining a plurality of cups (212) open to an outer surface (2160) of the ejection plate, each ejection plate defining one or more air conduits (214) extending from each cup of the plurality of cups to an inner surface (2161) of the ejection plate facing radially inward toward the second central rotation axis, and an ejection device (230) fixed in position in relation to the ejection wheel, the ejection device including a gas supply manifold (232) having a gas discharge port (234) defining an ejection position (270) of the ejection device that is fixed in relation to the ejection wheel and at least partially defines a material receiving position (170) of the rotatable apparatus overlapping the ejection device in a vertical direction (174) extending in parallel to the first central rotation axis, the material receiving position fixed in relation to the ejection device; and the operating the ejection system includes rotating the ejection wheel around the second central rotation axis at a second rate of rotation to continuously move the plurality of ejection plates through the ejection position concurrently with operating the ejection device to direct a gas through the gas discharge port at the ejection position, to cause the gas to be directed into one or more cups of one or more ejection plates of the plurality of ejection plates based on the one or more ejection plates moving through the ejection position.

Example Embodiment 14: A packaging machine (1), comprising:

a rotatable apparatus (100) configured to rotate a circumferential pattern (113) of a plurality of funnels (116) around a first central rotation axis (112) at a first rate of rotation concurrently with a plurality of containers (82) moving continuously along an arcuate path (84) while axially aligned with separate, respective bottom openings (116U) of the plurality of funnels; and an ejection system (20) configured to eject separate pluralities of material articles (90) from a fixed ejection position (270) at a fixed time interval, wherein the rotatable apparatus is configured to direct a same quantity of the material articles into each of the plurality of containers based on the rotatable apparatus rotating the plurality of funnels around the first central rotation axis at the first rate of rotation such that each separate funnel of the plurality of funnels moves continuously through a material receiving position (170) that is fixed in relation to the ejection system concurrently with the rotatable apparatus receiving at least one of the separate pluralities of material articles at the material receiving position.

Example Embodiment 15: The packaging machine of Example Embodiment 14, wherein the ejection system is configured to eject each separate plurality of material articles as a linear pattern of material articles aligned with a radial direction (172) extending radially from the first central rotation axis and intersecting the material receiving position, the radial direction fixed in relation to the ejection system, and the rotatable apparatus is configured to direct separate portions of at least one linear pattern of material articles received at the material receiving position into different, azimuthally adjacent funnels (116-1, 116-2) of the plurality of funnels at least partially simultaneously located at the material receiving position.

Example Embodiment 16: The packaging machine of Example Embodiment 15, wherein the rotatable apparatus is configured to direct the separate portions of the at least one linear pattern of material articles into the different, azimuthally adjacent funnels according to respective radial proximities of the separate portions to the first central rotation axis.

Example Embodiment 17: The packaging machine of Example Embodiment 15, wherein the plurality of funnels includes a set (118) of funnels, the set of funnels including a first funnel (116-1) having a first funnel top opening (116U-1), a second funnel (116-2) having a second funnel top opening (116U-2), and a third funnel (116-3) having a third funnel top opening (116U-3), the first funnel is azimuthally between the second funnel and the third funnel, the first funnel top opening is azimuthally symmetric, and the second funnel top opening and the third funnel top opening are each azimuthally asymmetric and have reflective azimuthal symmetry around an axis of symmetry (128) that extends radially from the first central rotation axis.

Example Embodiment 18: The packaging machine of Example Embodiment 14, wherein the rotatable apparatus is configured to direct each material article received into each separate funnel of the plurality of funnels into a separate air vent conduit (130) such that air displaced by the material article moving through the separate air vent conduit is vented externally to the separate air vent conduit through one or more openings (130A) extending through a thickness (130T) of a cylindrical sidewall of the separate air vent conduit.

Example Embodiment 19: The packaging machine of Example Embodiment 14, wherein the ejection system includes an ejection wheel (200) having a second central rotation axis (202), the ejection wheel including a separate circumferential pattern of a plurality of ejection plates (210) having respective outer surfaces (2160) radially outward from the second central rotation axis and collectively defining an outer cylindrical rim (2040) of the ejection wheel, each ejection plate defining a plurality of cups (212) open to an outer surface (2160) of the ejection plate, and an ejection device (230) defining an ejection position (270) that is fixed in position in relation to the ejection wheel, the ejection device configured to cause material articles held in the plurality of cups of each ejection plate to be ejected from the ejection system based on the ejection wheel rotating the ejection plate through the ejection position.

Example Embodiment 20: The packaging machine of Example Embodiment 14, wherein a ratio of the same quantity of material articles to a quantity of material articles in each separate plurality of material articles is a rational number and is not either of an integer, or a fraction 1/x where x is an integer.

Example Embodiment 21: The packaging machine of Example Embodiment 14, wherein the rotatable apparatus is configured to direct separate portions of at least one plurality of material articles ejected by the ejection system into different, azimuthally adjacent funnels (116-1, 116-2) at least partially simultaneously located at the material receiving position.

Example Embodiment 22: The packaging machine of Example Embodiment 21, wherein the rotatable apparatus is configured to direct the separate portions of the at least one plurality of material articles into the different, azimuthally adjacent funnels according to respective radial proximities of the separate portions to the first central rotation axis.

Example Embodiment 23: A method, comprising:

rotating a rotatable apparatus (100) including a circumferential pattern (113) of a plurality of funnels (116) around a first central rotation axis (112) at a first rate of rotation to cause a plurality of containers (82) to be moved continuously along an arcuate path (84) while axially aligned with separate, respective bottom openings (116U) of separate, respective funnels of the plurality of funnels; and operating an ejection system (20) to eject separate pluralities (602) of material articles (90) at a fixed time interval concurrently with the rotatable apparatus rotating around the first central rotation axis at the first rate of rotation, such that the rotatable apparatus directs each separate plurality of material articles into one or more containers of the plurality of containers via one or more funnels of the plurality of funnels while maintaining continuous movement of the plurality of containers along the arcuate path.

Example Embodiment 24: The method of Example Embodiment 23, wherein the ejection system includes an ejection wheel (200) having a second central rotation axis (202), the ejection wheel including a separate circumferential pattern of a plurality of ejection plates (210) having respective outer surfaces (2160) facing radially outward from the second central rotation axis and collectively defining an outer cylindrical rim (2040) of the ejection wheel, each ejection plate defining a plurality of cups (212) open to an outer surface of the ejection plate, each ejection plate defining one or more air conduits (214) extending from each cup of the plurality of cups to an inner surface (2161) of the ejection plate facing radially inward toward the second central rotation axis, and an ejection device configured to eject material articles from each ejection plate of the ejection wheel at an ejection position (270) that is fixed in relation to the ejection wheel and at least partially defines a material receiving position (170) of the rotatable apparatus overlapping the ejection device in a vertical direction (174) extending in parallel to the first central rotation axis, such that the material receiving position is fixed in relation to the ejection device; and the operating the ejection system includes rotating the ejection wheel around the second central rotation axis at a second rate of rotation to continuously move the plurality of ejection plates through the ejection position concurrently with operating the ejection device to direct a gas through a gas discharge port at the ejection position, to cause the gas to be directed into one or more cups of one or more ejection plates of the plurality of ejection plates based on the one or more ejection plates moving through the ejection position.

Example Embodiment 25: The method of Example Embodiment 23, wherein each separate plurality of material articles ejected by the ejection system is a linear pattern of material articles aligned with a radial direction (172) extending radially from the first central rotation axis and intersecting a material receiving position of the rotatable apparatus, and the operating the ejection system to eject the separate pluralities of material articles at the fixed time interval concurrently with the rotatable apparatus rotating around the first central rotation axis at the first rate of rotation causes separate portions of at least one linear pattern of material articles received at the material receiving position to be directed by the rotatable apparatus into different, azimuthally adjacent (116-1, 116-2) funnels of the plurality of funnels at least partially simultaneously located at the material receiving position.

Example Embodiment 26: The method of Example Embodiment 25, wherein the operating the ejection system to eject the separate pluralities of material articles at the fixed time interval concurrently with the rotatable apparatus rotating around the first central rotation axis at the first rate of rotation causes the separate portions of the at least one linear pattern of material articles to be directed by the rotatable apparatus into the different, azimuthally adjacent funnels (116-1, 116-2) according to respective radial proximities of the separate portions to the first central rotation axis.

Example Embodiment 27: The method of Example Embodiment 23, wherein the operating the ejection system to eject the separate pluralities of material articles at the fixed time interval concurrently with the rotatable apparatus rotating around the first central rotation axis at the first rate of rotation causes a same quantity of materials to be directed into separate, respective containers axially aligned under separate, respective funnels of the plurality of funnels, such that a ratio of the same quantity of material articles to a quantity of material articles in each separate plurality of material articles is a rational number and is not either of an integer, or a fraction 1/x where x is an integer.

While some example embodiments have been disclosed herein, it should be understood that other variations may be possible. Such variations are not to be regarded as a departure from the spirit and scope of the present inventive concepts, and all such modifications as would be obvious to one skilled in the art are intended to be included within the scope of the following claims.

What is claimed:

1. A rotatable apparatus, comprising:

a rotatable drum having a first central rotation axis and including a circumferential pattern of a plurality of funnels having rotational symmetry around the first central rotation axis, each funnel of the plurality of funnels defining a top opening at a top end of the rotatable drum and a bottom opening at a bottom end of the rotatable drum; and a rotatable turret rotationally fixed to the rotatable drum, the rotatable turret including a circumferential plurality of arms having rotational symmetry around the first central rotation axis and at least partially defining a plurality of recesses that have rotational symmetry around the first central rotation axis and axially overlap separate, respective funnel bottom openings of the plurality of funnels of the rotatable drum, wherein two azimuthally adjacent funnels of the plurality of funnels define respective two azimuthally adjacent top openings having different intrinsic shapes.

2. The rotatable apparatus of claim 1, wherein one top opening of the respective two azimuthally adjacent top openings is azimuthally asymmetric.

3. The rotatable apparatus of claim 1, wherein the respective two azimuthally adjacent top openings at least partially overlap in a radial direction extending radially from the first central rotation axis.

4. The rotatable apparatus of claim 3, wherein:

each top opening of the respective two azimuthally adjacent top openings defines at least one first azimuthal area and at least one second azimuthal area that is partially azimuthally adjacent to the at least one first azimuthal area, the at least one first azimuthal area having a greater radial width than the at least one second azimuthal area, and at least one second azimuthal area of one of the respective two azimuthally adjacent top openings at least partially overlaps at least one second azimuthal area of another one of the respective two azimuthally adjacent top openings in the radial direction.

5. The rotatable apparatus of claim 4, wherein:

a first azimuthal area of at least one top opening of the respective two azimuthally adjacent top openings has a first radial width that is a radial width between a radially outermost inner surface and a radially innermost inner surface of the at least one top opening, and at least one second azimuthal area of the at least one top opening has a second radial width that extends radially from one of the radially outermost inner surface or the radially innermost inner surface of the at least one top opening.

6. The rotatable apparatus of claim 1, wherein:

the plurality of funnels includes a set of funnels, the set of funnels including a first funnel having a first funnel top opening, a second funnel having a second funnel top opening, and a third funnel having a third funnel top opening, the first funnel is azimuthally between the second funnel and the third funnel, the first funnel top opening is azimuthally symmetric, and the second funnel top opening and the third funnel top opening are each azimuthally asymmetric and have reflective azimuthal symmetry around an axis of symmetry that extends radially from the first central rotation axis.

7. The rotatable apparatus of claim 1, further comprising:

a plurality of air vent conduits extending from separate, respective bottom openings of the plurality of funnels to separate, respective recesses of the rotatable turret, each air vent conduit including one or more openings extending through a thickness of a cylindrical sidewall of the air vent conduit.

8. A packaging machine, comprising:

the rotatable apparatus of claim 1; and an ejection system, the ejection system configured to eject separate pluralities of material articles at a fixed time interval.

9. The packaging machine of claim 8, wherein the ejection system includes:

an ejection wheel having a second central rotation axis, the ejection wheel including a separate circumferential pattern of a plurality of ejection plates having respective outer surfaces facing radially outward from the second central rotation axis and collectively defining an outer cylindrical rim of the ejection wheel, each ejection plate defining a plurality of cups open to an outer surface of the ejection plate, each ejection plate defining one or more air conduits extending from each cup of the plurality of cups to an inner surface of the ejection plate facing radially inward toward the second central rotation axis, and an ejection device fixed in position in relation to the ejection wheel, the ejection device including a gas supply manifold having a gas discharge port defining an ejection position of the ejection device that is fixed in relation to the ejection wheel and at least partially defines a material receiving position of the rotatable apparatus overlapping the ejection device in a vertical direction extending in parallel to the first central rotation axis, such that the material receiving position is fixed in relation to the ejection device.

10. The packaging machine of claim 8, wherein:

the rotatable apparatus is configured to rotate the circumferential pattern of the plurality of funnels around the first central rotation axis at a first rate of rotation concurrently with a plurality of containers moving continuously along an arcuate path while axially aligned with separate, respective bottom openings of the plurality of funnels; and the rotatable apparatus is configured to direct a same quantity of material articles into each of the plurality of containers based on the rotatable apparatus rotating the plurality of funnels around the first central rotation axis at the first rate of rotation such that each separate funnel of the plurality of funnels moves continuously through a material receiving position that is fixed in relation to the ejection system concurrently with the rotatable apparatus receiving at least one of the separate pluralities of material articles at the material receiving position.

11. The packaging machine of claim 10, wherein:

the ejection system is configured to eject each separate plurality of material articles as a linear pattern of material articles aligned with a radial direction extending radially from the first central rotation axis and intersecting the material receiving position, the radial direction fixed in relation to the ejection system, and the rotatable apparatus is configured to direct separate portions of at least one linear pattern of material articles received at the material receiving position into different, azimuthally adjacent funnels of the plurality of funnels at least partially simultaneously located at the material receiving position.

12. The packaging machine of claim 11, wherein the rotatable apparatus is configured to direct the separate portions of the at least one linear pattern of material articles into the different, azimuthally adjacent funnels according to respective radial proximities of the separate portions to the first central rotation axis.

13. The packaging machine of claim 10, wherein the rotatable apparatus is configured to direct separate portions of at least one plurality of material articles ejected by the ejection system into different, azimuthally adjacent funnels at least partially simultaneously located at the material receiving position.

14. The packaging machine of claim 13, wherein the rotatable apparatus is configured to direct the separate portions of the at least one plurality of material articles into the different, azimuthally adjacent funnels according to respective radial proximities of the separate portions to the first central rotation axis.

15. A method of operating the packaging machine of claim 8, the method comprising:

rotating the rotatable apparatus around the first central rotation axis at a first rate of rotation to continuously move the plurality of funnels through a material receiving position and to cause the rotatable turret to cause a plurality of containers to move continuously along an arcuate path while axially aligned with separate, respective bottom openings of the plurality of funnels; and operating the ejection system to eject the separate pluralities of material articles into the material receiving position at the fixed time interval concurrently with the rotatable apparatus rotating around the first central rotation axis at the first rate of rotation.

16. The method of claim 15, wherein:

the ejection system includes:

an ejection wheel having a second central rotation axis, the ejection wheel including a separate circumferential pattern of a plurality of ejection plates having respective outer surfaces facing radially outward from the second central rotation axis and collectively defining an outer cylindrical rim of the ejection wheel, each ejection plate defining a plurality of cups open to an outer surface of the ejection plate, each ejection plate defining one or more air conduits extending from each cup of the plurality of cups to an inner surface of the ejection plate facing radially inward toward the second central rotation axis, and an ejection device fixed in position in relation to the ejection wheel, the ejection device including a gas supply manifold having a gas discharge port defining an ejection position of the ejection device that is fixed in relation to the ejection wheel and at least partially defines the material receiving position overlapping the ejection device in a vertical direction extending in parallel to the first central rotation axis, the material receiving position fixed in relation to the ejection device; and the operating the ejection system includes rotating the ejection wheel around the second central rotation axis at a second rate of rotation to continuously move the plurality of ejection plates through the ejection position concurrently with operating the ejection device to direct a gas through the gas discharge port at the ejection position, to cause the gas to be directed into one or more cups of one or more ejection plates of the plurality of ejection plates based on the one or more ejection plates moving through the ejection position.

17. The method of claim 15, wherein:

each separate plurality of material articles ejected by the ejection system is a linear pattern of material articles aligned with a radial direction extending radially from the first central rotation axis and intersecting the material receiving position, and the operating the ejection system to eject the separate pluralities of material articles into the material receiving position at the fixed time interval concurrently with the rotatable apparatus rotating around the first central rotation axis at the first rate of rotation causes separate portions of at least one linear pattern of material articles received at the material receiving position to be directed by the rotatable apparatus into different, azimuthally adjacent funnels of the plurality of funnels at least partially simultaneously located at the material receiving position.

18. The method of claim 17, wherein the operating the ejection system to eject the separate pluralities of material articles into the material receiving position at the fixed time interval concurrently with the rotatable apparatus rotating around the first central rotation axis at the first rate of rotation causes the separate portions of the at least one linear pattern of material articles to be directed by the rotatable apparatus into the different, azimuthally adjacent funnels according to respective radial proximities of the separate portions to the first central rotation axis.

19. The method of claim 15, wherein the operating the ejection system to eject the separate pluralities of material articles into the material receiving position at the fixed time interval concurrently with the rotatable apparatus rotating around the first central rotation axis at the first rate of rotation causes a same quantity of materials to be directed into separate, respective containers axially aligned under separate, respective funnels of the plurality of funnels, such that a ratio of the same quantity of material articles to a quantity of material articles in each separate plurality of material articles is a rational number and is not either of:

an integer, or a fraction 1/x where x is an integer.

* * * * *